US010519016B2

(12) United States Patent
Kelly et al.

(10) Patent No.: US 10,519,016 B2
(45) Date of Patent: Dec. 31, 2019

(54) APPARATUS AND METHODS OF OPENING CONTAINERS

(71) Applicant: DRAFT TOP, LLC, Monmouth Beach, NJ (US)

(72) Inventors: Sean P. Kelly, Marietta, GA (US); Armand Joseph Ferranti, Jr., Long Branch, NJ (US)

(73) Assignee: DRAFT TOP, LLC, Monmouth Beach, NJ (US)

( * ) Notice: Subject to any disclaimer, the term of this patent is extended or adjusted under 35 U.S.C. 154(b) by 137 days.

(21) Appl. No.: 15/524,514

(22) PCT Filed: Nov. 24, 2015

(86) PCT No.: PCT/US2015/062379

§ 371 (c)(1),
(2) Date: May 4, 2017

(87) PCT Pub. No.: WO2016/085958

PCT Pub. Date: Jun. 2, 2016

(65) Prior Publication Data

US 2017/0355583 A1 Dec. 14, 2017

Related U.S. Application Data

(60) Provisional application No. 62/084,666, filed on Nov. 26, 2014.

(51) Int. Cl.

| | |
|---|---|
| ***B67B 7/46*** | (2006.01) |
| ***B67B 7/16*** | (2006.01) |
| ***B67B 7/44*** | (2006.01) |

(52) U.S. Cl.

CPC ..... *B67B 7/34* (2013.01); *B67B 7/16* (2013.01); *B67B 7/44* (2013.01); *B67B 2007/303* (2013.01)

(58) Field of Classification Search

CPC .. B67B 7/16; B67B 7/162; B67B 7/30; B67B 7/44; B67B 2007/303; B67B 7/32; B67B 7/34; B67B 7/36

(Continued)

(56) References Cited

U.S. PATENT DOCUMENTS 505,328 A * 9/1893 Pratt ..... B23D 21/145 30/106
643,961 A * 2/1900 Hanten ..... B23D 21/14 30/108

(Continued)

FOREIGN PATENT DOCUMENTS

GB 2161449 B 5/1988
JP 2005-082241 A 3/2005

(Continued)

OTHER PUBLICATIONS

Korean Intellectual Property Office/ISA of PCT Office, International Search Report and Written Opinion dated Mar. 17, 2016, pp. 1-13.

*Primary Examiner* — Evan H MacFarlane
(74) *Attorney, Agent, or Firm* — Duane Morris LLP

(57) ABSTRACT

An apparatus and methods of opening containers which permit the user to remove the entire flat upper planar surface. The apparatus and methods, incorporate a platform with a plurality of arms operatively coupled to respective blade members that engage inner circumferential edge of a container by folding the edges inward. The blade members and arms are operatively coupled to a lever and rotate outward when the lever is compressed. The inventors have determined that apparatus and methods provided herein are able to adhere to the different sizes and contours of a sealed can lid. Additionally, by way of example, the inventors have determined that apparatus and methods provided herein can permit the user to safely remove the top of the can with both ease and efficiency.

18 Claims, 31 Drawing Sheets

(58) Field of Classification Search
USPC ..... 30/400, 416–418, 108, 103–106; 7/152, 7/153
See application file for complete search history.

(56) References Cited

U.S. PATENT DOCUMENTS

| | | | | |
|---|---|---|---|---|
| 896,822 | A | 8/1908 | Gorin | |
| 999,668 | A | 8/1911 | Montaperto | |
| 1,102,962 | A | 7/1914 | Schonfeld | |
| 1,447,370 | A | 3/1923 | Winn | |
| 1,472,862 | A | 11/1923 | Angell | |
| 1,474,466 | A * | 11/1923 | Felton | B67B 7/34 30/436 |
| 1,842,047 | A | 1/1932 | Poeppel | |
| 1,922,630 | A * | 8/1933 | Oberhuber | B23D 21/145 30/105 |
| 2,674,911 | A * | 4/1954 | Theis | B67B 7/18 269/131 |
| 2,749,612 | A * | 6/1956 | Blue | B67B 7/34 30/410 |
| 2,814,015 | A * | 11/1957 | Kuhrt | G06G 7/182 323/368 |
| 2,814,105 | A * | 11/1957 | Smith | B23D 21/08 30/105 |
| 3,002,274 | A | 10/1961 | Jepson et al. | |
| 3,008,231 | A | 11/1961 | Caproni | |
| 4,125,941 | A | 4/1978 | McKinley | |
| 4,133,228 | A * | 1/1979 | DePooter | B67B 7/16 220/274 |
| 4,155,160 | A | 5/1979 | Bobo | |
| 4,177,559 | A * | 12/1979 | Anderson | B23D 21/145 30/105 |
| 4,279,077 | A | 7/1981 | Freeman | |
| 4,633,589 | A | 1/1987 | Gray | |
| 4,648,183 | A | 3/1987 | Jacobs | |
| 4,845,844 | A | 7/1989 | Allen | |
| 4,852,255 | A | 8/1989 | Hochfeld | |
| 4,858,805 | A | 8/1989 | Hochfeld | |
| D304,900 | S | 12/1989 | Miquelot | |
| 5,201,788 | A | 4/1993 | La Naour | |
| 5,205,195 | A | 4/1993 | Crosslen et al. | |
| 5,291,658 | A | 3/1994 | Wilson et al. | |
| 5,361,502 | A | 11/1994 | Derwin | |
| 5,581,897 | A | 12/1996 | Liebscher | |
| 5,802,725 | A | 9/1998 | Drifka et al. | |
| 5,903,980 | A | 5/1999 | Collier et al. | |
| 6,000,262 | A | 12/1999 | Dries et al. | |
| 6,101,727 | A | 8/2000 | Chong | |
| 6,108,917 | A | 8/2000 | Bellis et al. | |
| 6,374,502 | B1 | 4/2002 | Holcomb et al. | |
| 6,477,775 | B2 | 11/2002 | Scribner et al. | |
| 6,671,970 | B2 | 1/2004 | Chong | |
| 6,715,266 | B2 | 4/2004 | Browning | |
| 6,789,325 | B2 | 9/2004 | Wilson | |
| 6,810,587 | B1 | 11/2004 | Robertson | |
| 6,886,437 | B2 | 5/2005 | Waldstadt | |
| 6,912,931 | B1 | 7/2005 | Drauer et al. | |
| 6,935,208 | B1 * | 8/2005 | Cruthirds | B67B 7/16 43/42.47 |
| 7,028,359 | B2 | 4/2006 | Mazur | |
| D521,827 | S | 5/2006 | So | |
| 7,121,009 | B2 | 10/2006 | Robbins et al. | |
| D562,658 | S | 2/2008 | So | |
| 7,596,874 | B2 | 10/2009 | Mah et al. | |
| 7,784,190 | B2 | 8/2010 | So | |
| 8,266,991 | B2 | 9/2012 | Thorson et al. | |
| 8,539,682 | B2 | 9/2013 | Mah et al. | |
| 8,695,457 | B2 | 4/2014 | Rozmus et al. | |
| 8,833,209 | B2 * | 9/2014 | Brown | B25B 13/10 81/90.1 |
| 8,991,057 | B2 | 3/2015 | Jaynes | |
| 2003/0150297 | A1 | 8/2003 | Mazur | |
| 2005/0028646 | A1 | 2/2005 | Hefti et al. | |
| 2006/0117462 | A1 * | 6/2006 | Wysopal | A42B 1/24 2/209.13 |
| 2007/0033815 | A1 | 2/2007 | Lazaroff et al. | |
| 2007/0143929 | A1 * | 6/2007 | Selin | B25F 1/00 7/151 |
| 2007/0193209 | A1 | 8/2007 | Bevers | |
| 2008/0307659 | A1 * | 12/2008 | Freeman | B67B 7/34 30/410 |
| 2014/0123505 | A1 | 5/2014 | Raghuprasad | |

FOREIGN PATENT DOCUMENTS

| | | |
|---|---|---|
| KR | 20-0451810 Y1 | 1/2011 |
| KR | 10-1402038 B1 | 6/2014 |

* cited by examiner

APPARATUS AND METHODS OF OPENING CONTAINERS

CROSS-REFERENCE TO RELATED APPLICATION

This application is a continuation-in-part of and claim priority to PCT Application No. PCT/US2015/62379 filed Nov. 24, 2015, which claims priority to U.S. Provisional Patent Application Ser. No. 62/084,666 filed Nov. 26, 2014, the entirety of each of which is incorporated herein by reference.

FIELD

The present disclosure generally relates to the technical field of cutlery and bar utensils. More specifically, the present disclosure is directed to an apparatus and method for removing the entire planar top portion of a sealed container, such as a sealed can.

DESCRIPTION OF THE RELATED ART

Traditional devices designed to remove the planar upper surface of a sealed container are limited in the types of containers they can open and are constrained in the method of accessing the container contents.

A recent trend among planar top surface soda or beverage cans is to engage the installed tab located at the top while including a perforated indentation opposite the tab to improve flow of the soda or beverage from the can once opened. This conventional technique is problematic because a separate tool is typically used to puncture the perforated indentation such as a key or other instrument. In addition, for applications in a bar or concession environment, the necessity to quickly deliver the container contents is not achieved because this two-step process is cumbersome or impractical. Finally, engaging the installed tab and puncturing the perforated indentation only increases flow of the soda or beverage from the can based on the limited dimensions of the tabbed mouth opening. For denser liquids flow is constrained. Concurrently, the developmental costs for changing and implementing a perforated indentation design are impractical for the limited amount of target consumers.

Traditional opening devices present various access challenges for planar top containers without an engagement tab or mouth. These devices use a single blade to remove the entire planar upper surface. These conventional devices require many rotations of a handle or crank to utilize the single blade to cut around the entire circumferential edge of the container. Electrical devices are also limited by the speed of the motor during the opening process. Furthermore, mechanical and electrical opening devices require set up and engagement of the single blade along the circumferential edge before commencing the opening process which is both time consuming and cumbersome. Moreover, the distance that the shoulder or lip of various containers protrudes outward from the engagement point of the blade can make the opening device ineffective by not allowing the blade to puncture and engage the container surface at an appropriate angle.

In addition, traditional mechanical and electrical devices remove the planar upper surface of a container while leaving sharp edges that are harmful to the operator upon removal. The contents of such containers subsequently need to be removed to an intermediate container for operator safety following the opening process.

SUMMARY

In some embodiments of the present disclosure, a can opener is provided including a platform, a lever operatively coupled to the platform, and a plurality of arms operatively coupled to the platform. Each respective arm of the plurality of arms has a respective blade. Movement of the lever toward the handle rotates each of the plurality of arms, which in turn, extends each respective blade outward from the center of the platform.

In various embodiments of the present disclosure, a device is provided including a base, a plurality of arms, each rotatably coupled to a surface of the base at a respective first end and including a respective blade disposed at a respective second end, a lever operatively coupled to the base and to the respective second end of each of said plurality of arms, and a capture device operatively coupled to the base. When the lever is in a first position, each respective second end is proximate a center of the base. When the lever is operated toward a second position, each respective second end is rotated outward from the center of the base.

Some embodiments of the present disclosure provide a method including positioning a surface of a platform of a device over an outer circumferential edge of a surface of a container, and extending each of a plurality of blades to engage respective portions of an inner circumferential edge of the surface of a container by compressing a lever of the device toward the platform of the device. The method also includes cutting the inner circumferential edge of the surface of a container by maintaining the lever adjacent with the platform and rotating the platform.

The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

Various aspects of the present disclosure will be or become apparent to one with skill in the art by reference to the following detailed description when considered in connection with the accompanying exemplary non-limiting embodiments.

DETAILED DESCRIPTION

Figure 1:
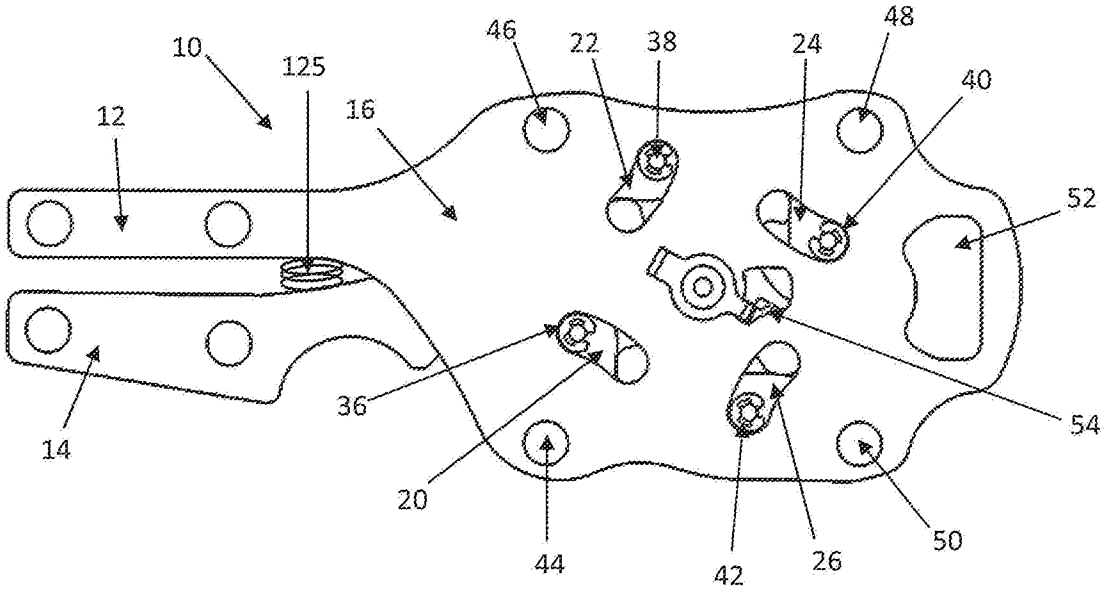
FIG. 1 is a top view of a container opening device in a closed position in accordance with some embodiments of the present disclosure.

With reference to the Figures, where like elements have been given like numerical designations to facilitate an understanding of the drawings, various embodiments of an apparatus and methods of opening containers are described. The figures are not drawn to scale.

The following description is provided as an enabling teaching of a representative set of examples. Many changes can be made to the embodiments described herein while still obtaining beneficial results. Some of the desired benefits discussed below can be obtained by selecting some of the features or steps discussed herein without utilizing other features or steps. Accordingly, many modifications and adaptations, as well as subsets of the features and steps described herein are possible and can even be desirable in certain circumstances. Thus, the following description is provided as illustrative and is not limiting.

This description of illustrative embodiments is intended to be read in connection with the accompanying drawings, which are to be considered part of the entire written description. The drawing figures are not necessarily to scale and certain features of the invention can be shown exaggerated in scale or in somewhat schematic form in the interest of clarity and conciseness. In the description of embodiments disclosed herein, any reference to direction or orientation is merely intended for convenience of description and is not intended in any way to limit the scope of the present disclosure. Relative terms such as "horizontal," "vertical," "up," "down," "top," and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral," and the like are to be interpreted relative to one another or relative to an axis of elongation, or an axis or center of rotation, as appropriate. Terms concerning attachments, coupling, and the like, such as "connected" "interconnected," "attached," and "affixed," refer to a relationship wherein structures are secured or attached to one another either directly or indirectly through intervening structures, as well as both movable or rigid attachments or relationships, unless expressly described otherwise. The terms "operatively connected" or operatively coupled" are such an attachment, coupling or connection that allows the pertinent structures to operate as intended by virtue of that relationship. The term "adjacent" as used herein to describe the relationship between structures/components includes both direct contact between the respective structures/components referenced and the presence of other intervening structures/components between respective structures/components.

As used herein, use of a singular article such as "a," "an" and "the" is not intended to exclude pluralities of the article's object unless the context clearly and unambiguously dictates otherwise.

The inventors have developed an apparatus and methods of opening sealed containers, such as sealed cans, which permit the user to remove the entire upper planar surface of such container while maintaining engagement with a pressed outer edge or rim of such container. For example, the inventors have determined that apparatus and methods provided herein are able to adhere to the different sizes and contours of a sealed container lid.

Additionally, by way of example, the inventors have determined that apparatus and methods provided herein can permit the user to safely remove the top of a sealed container with both ease and efficiency and with or without a clamping component. Further by way of example, the inventors have determined that apparatus and methods provided herein can permit the user to remove the entire upper planar surface of such container with minimal resulting sharp edges.

Figure 2:
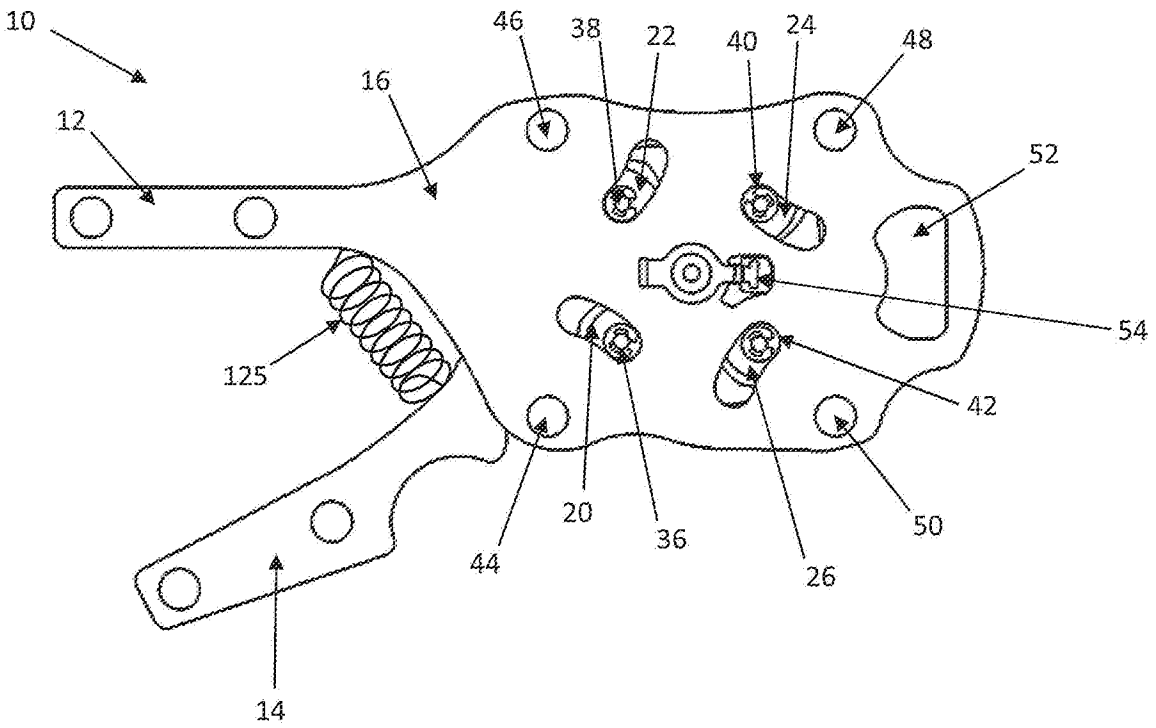
FIG. 2 is a top view of the device of FIG. 1 in an open position in accordance with some embodiments of the present subject matter.
Figure 15:
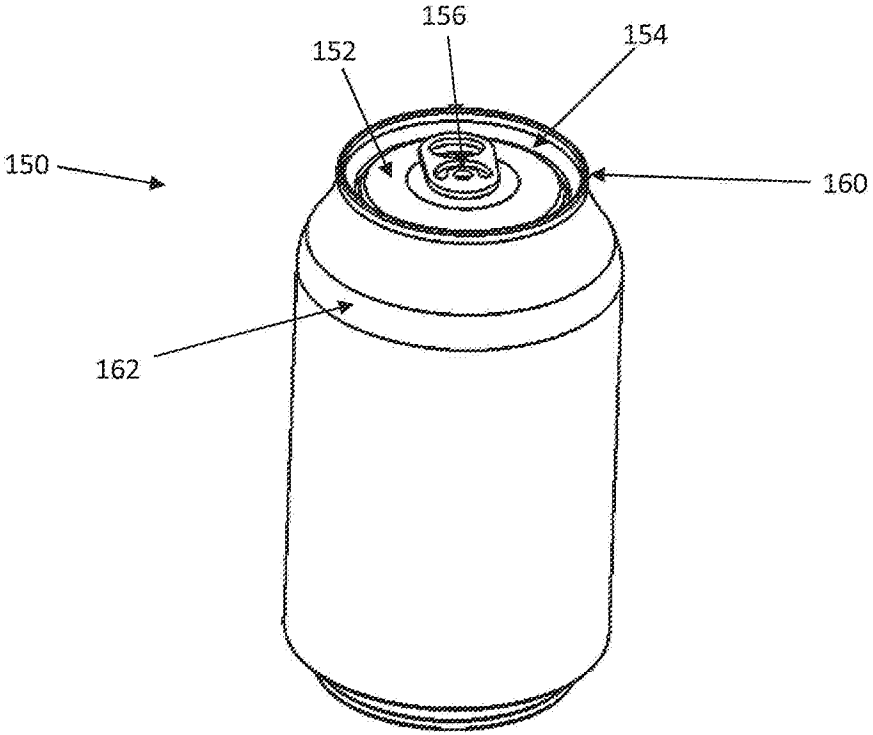
FIG. 15 is a perspective view of a can in accordance with some embodiments.
Figure 16:
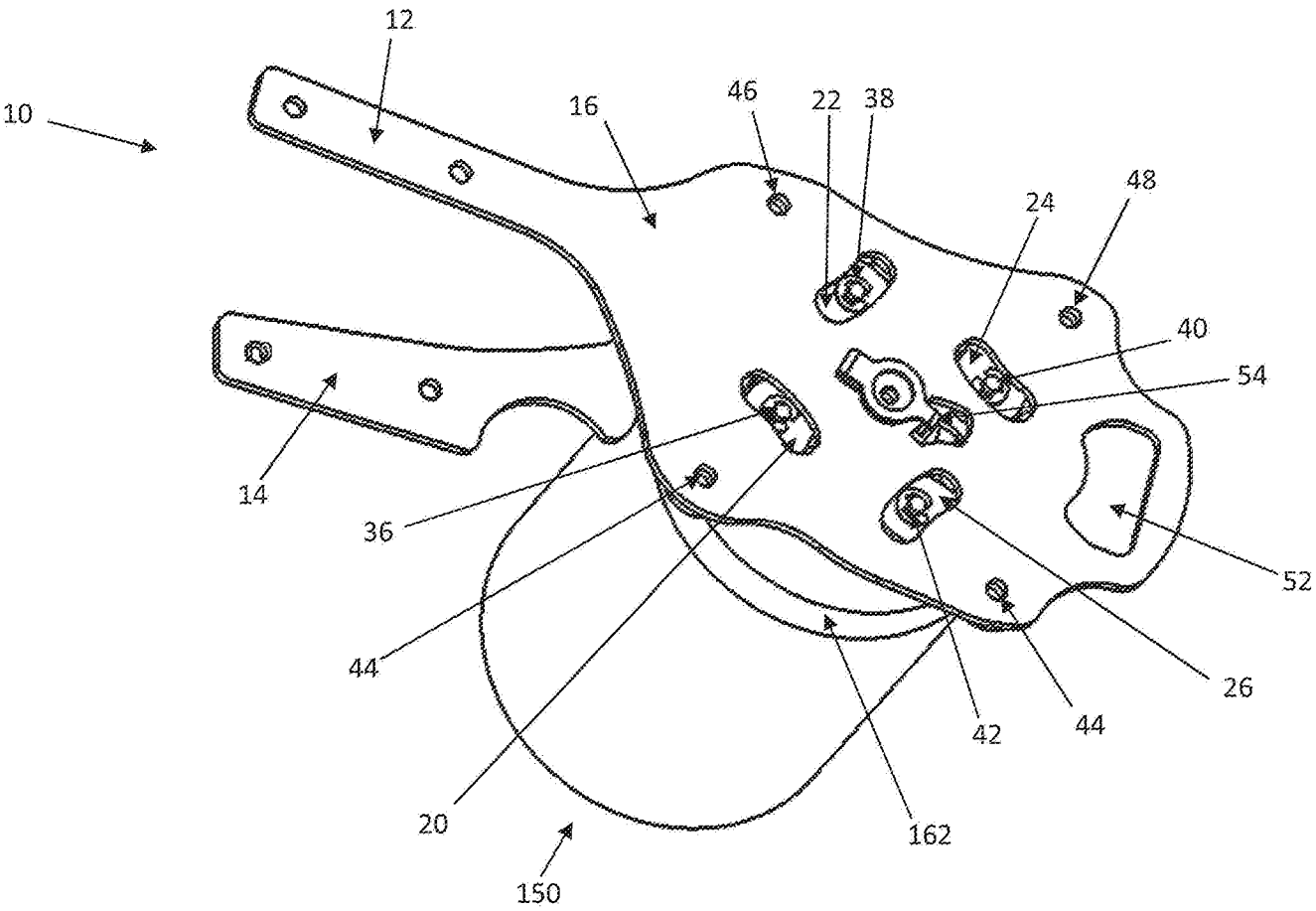
FIG. 16 is a top perspective view of a container opening device of FIG. 5 in an open position over an upper surface of a container in accordance with some embodiments of the present disclosure.
Figure 19:
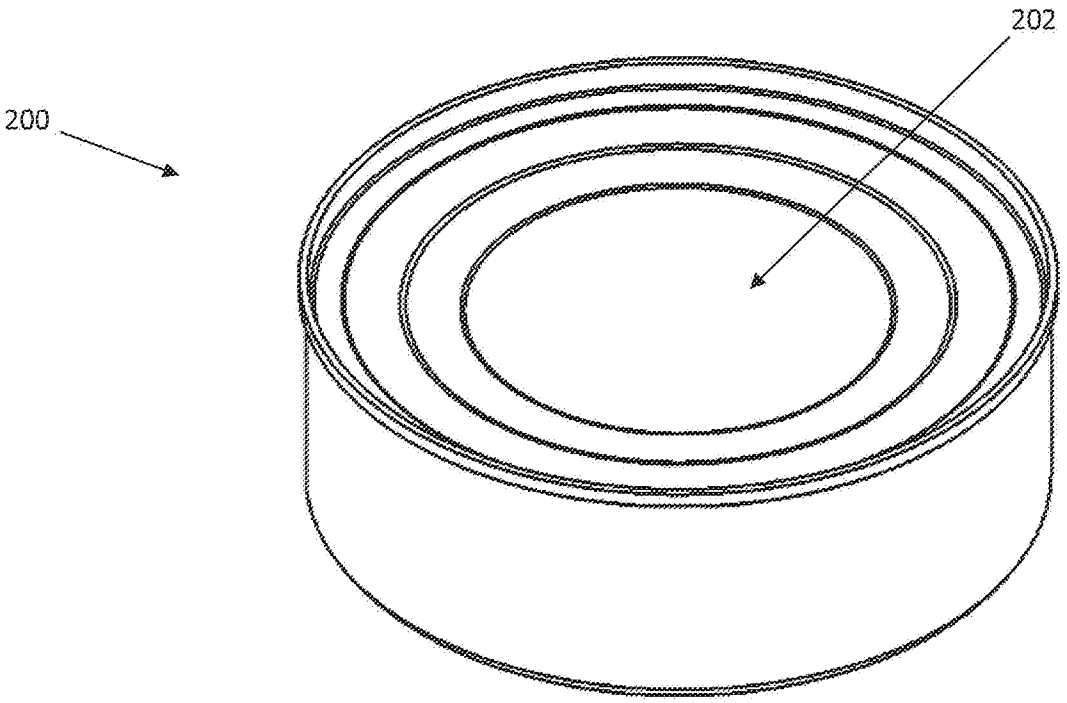
FIG. 19 is perspective view of a food container.
Figure 20:
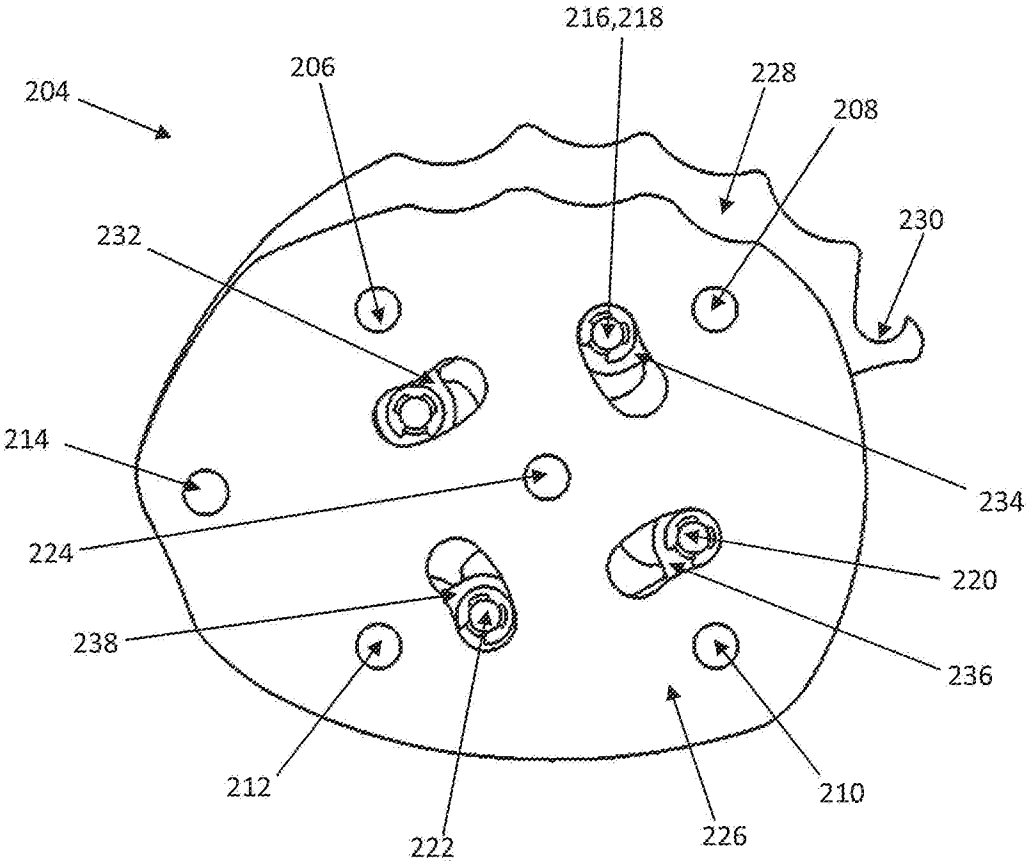
FIG. 20 is a top view of a container opening device in a closed position in accordance with some embodiments of the present disclosure.
Figure 21:
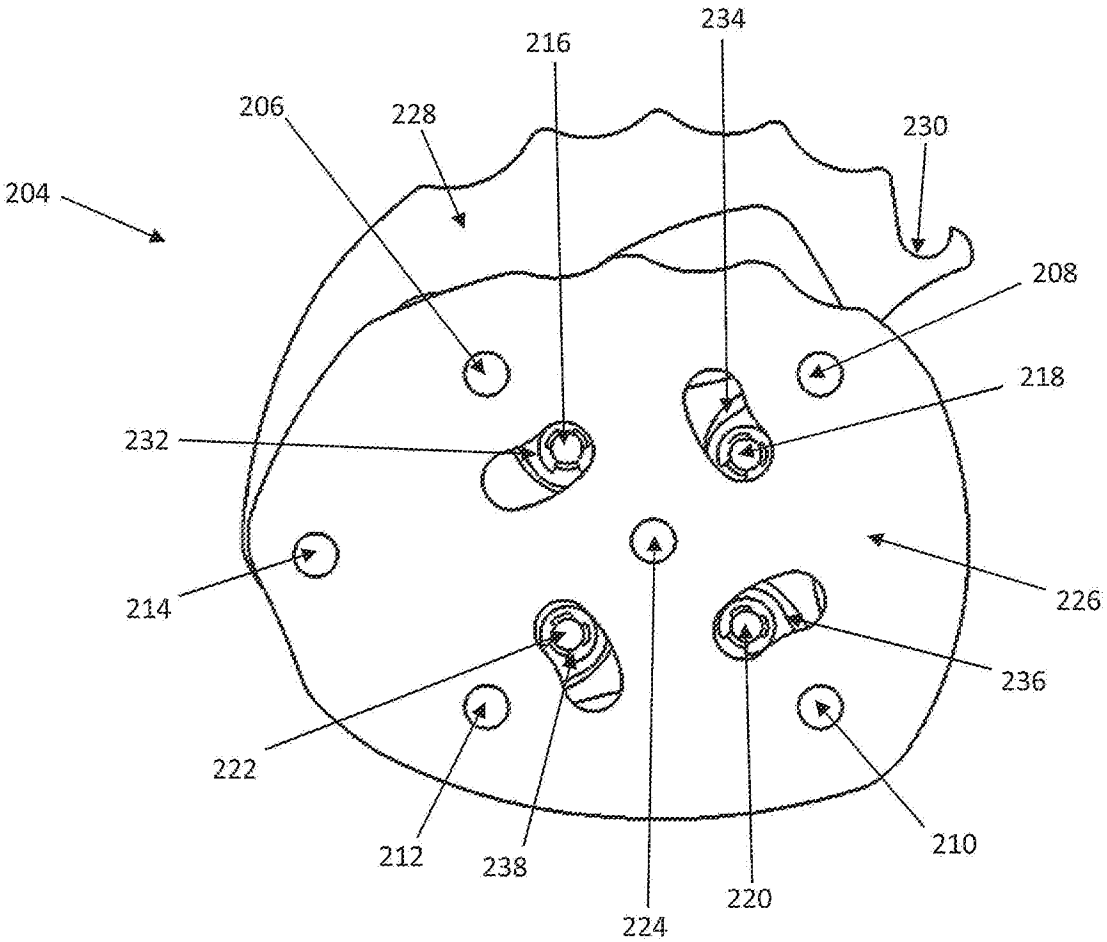
FIG. 21 is a top view of the device of FIG. 20 in an open position in accordance with some embodiments of the present disclosure.
Figure 22:
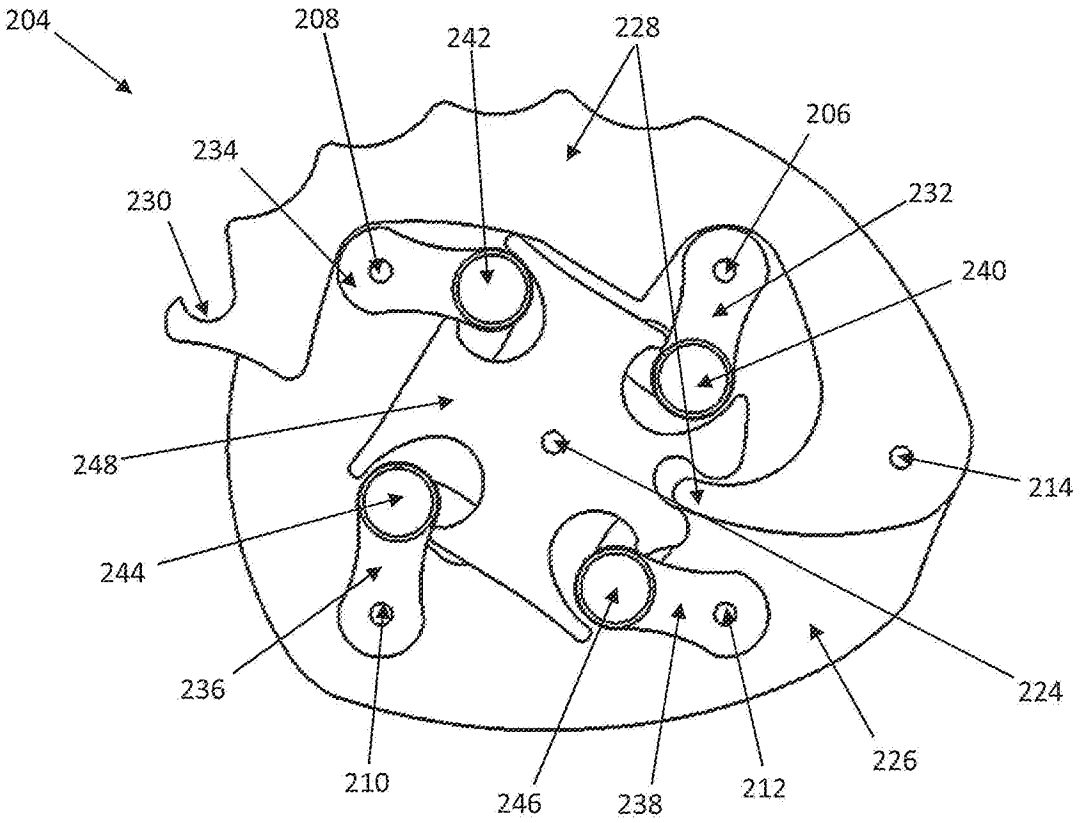
FIG. 22 is a bottom view of the device of FIG. 20 in a closed position in accordance with some embodiments of the present disclosure.
Figure 23:
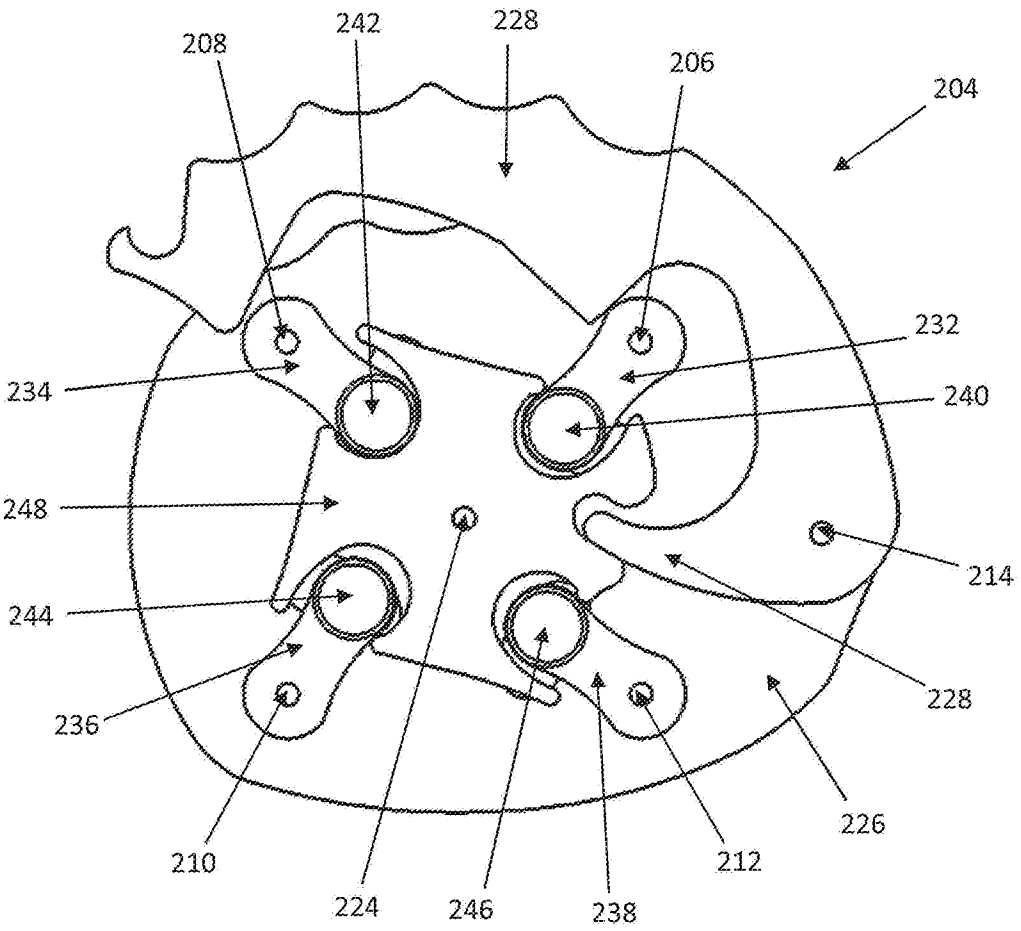
FIG. 23 is a bottom view of the device of FIG. 20 in an open position in accordance with some embodiments of the present disclosure.
Figure 24:
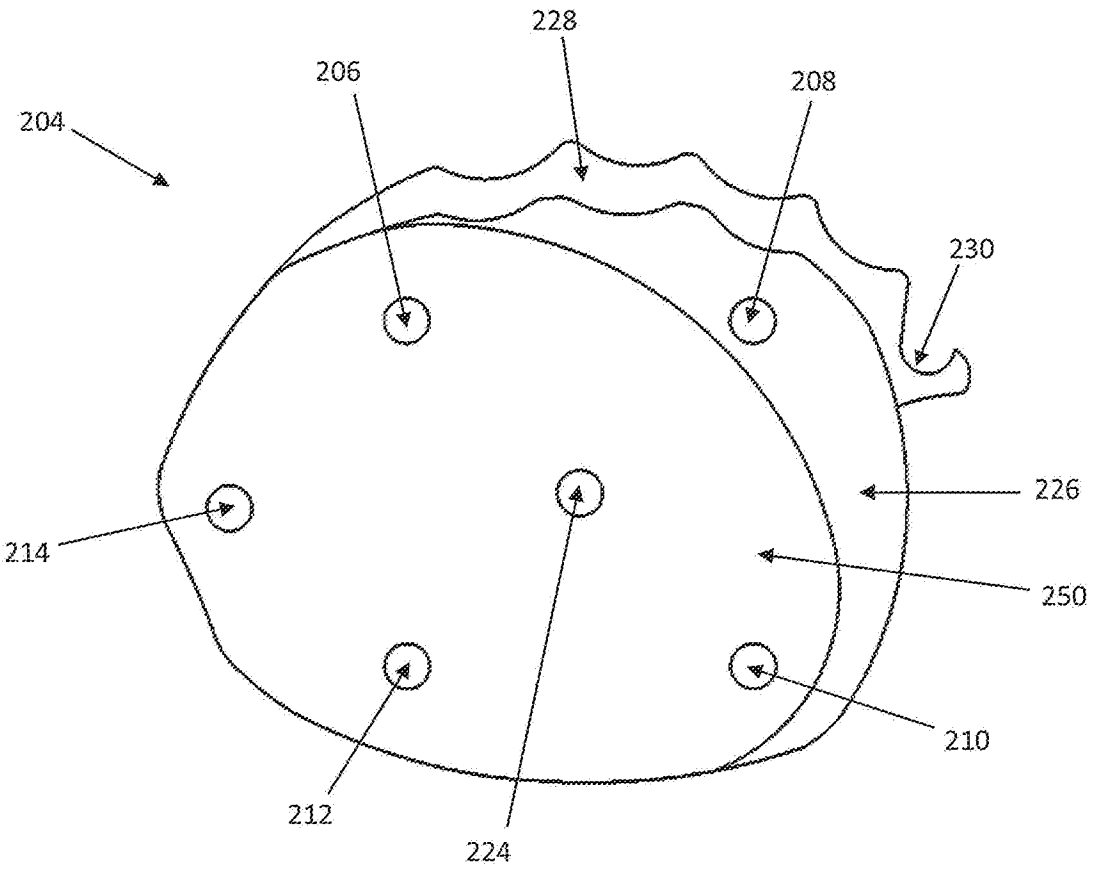
FIG. 24 is a top view of a container opening device in a closed position in accordance with some embodiments of the present subject matter.
Figure 25:
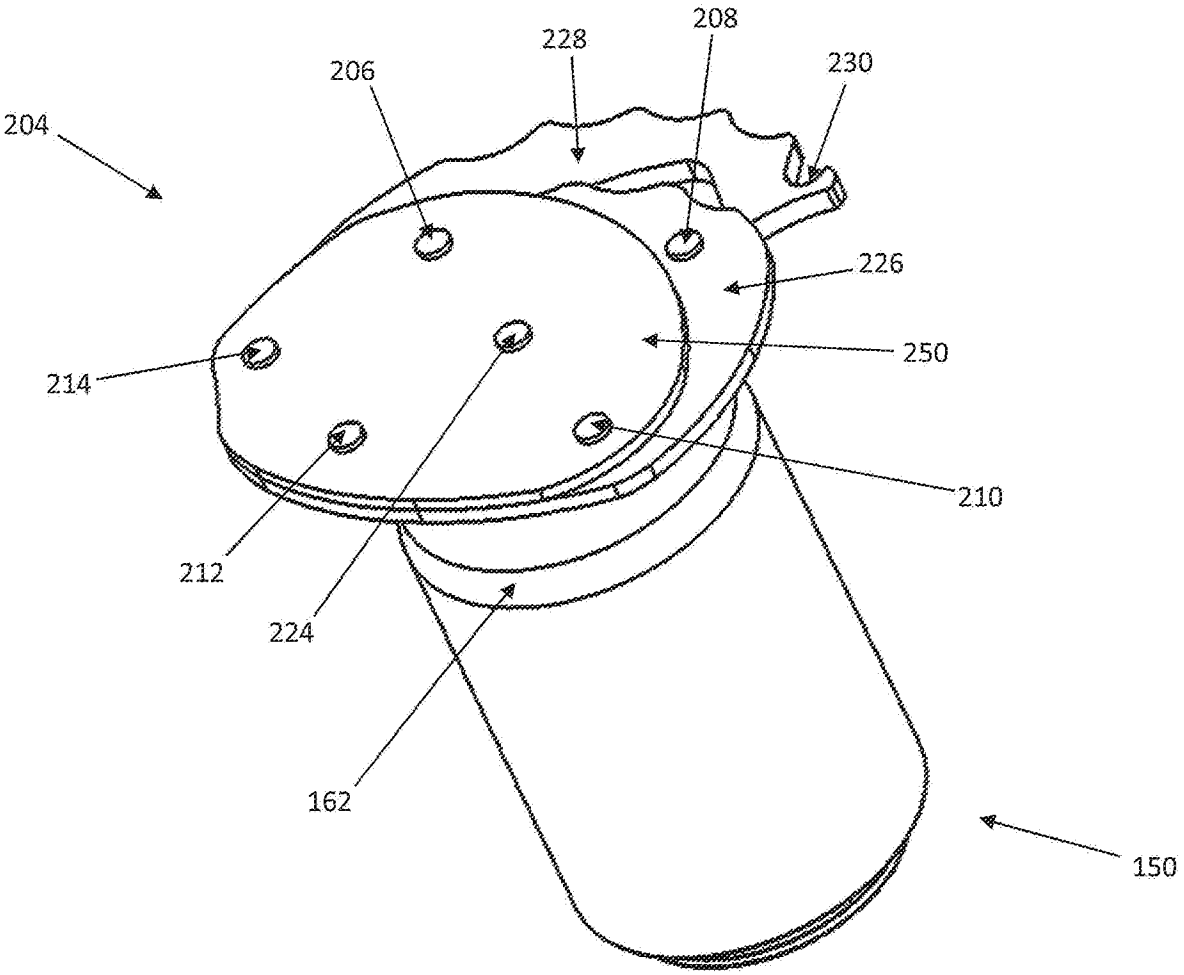
FIG. 25 is a top perspective view of the device of FIG. 24 in an open position over an upper surface of a container in accordance with some embodiments of the present disclosure.
Figure 26:
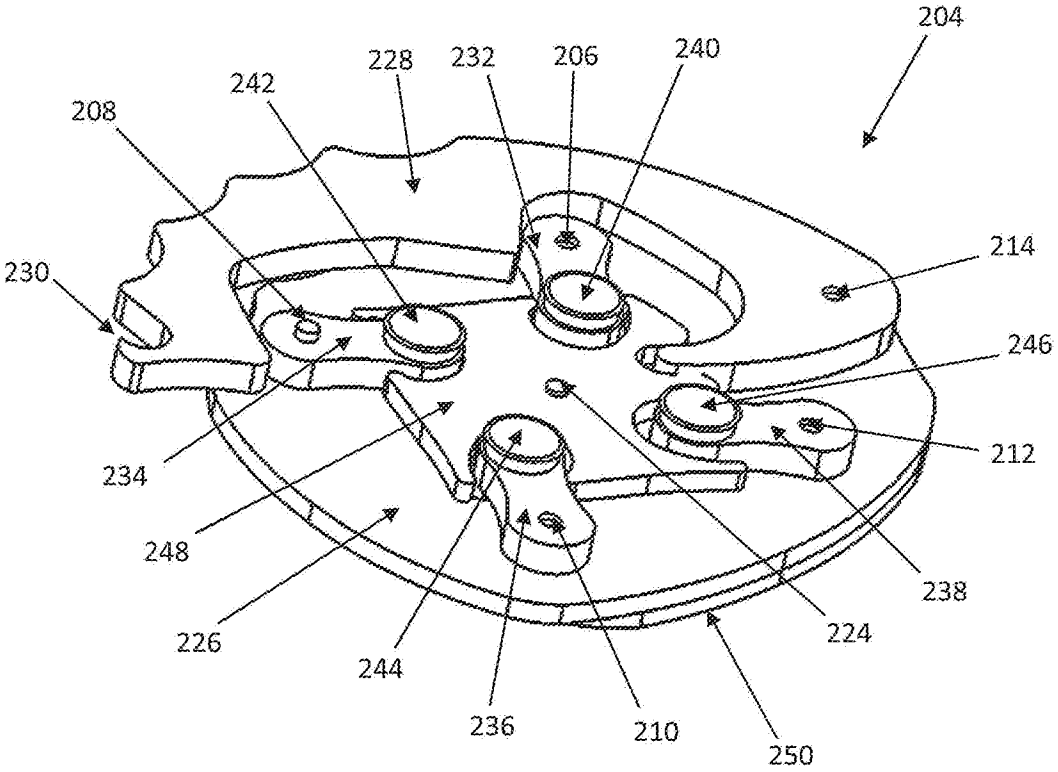
FIG. 26 is a bottom perspective view of the device of FIG. 24 with a cover in an open position in accordance with some embodiments of the present disclosure.

FIG. 1 is a top view of a container opening device 10 without a casing in a closed position according to various embodiments. In various embodiments, device 10 is configured to open a sealed container, such as a sealed beverage or food can (e.g. 150, FIG. 15, 200, FIG. 19). In some embodiments, device 10 may be a can opener. The container may be of any suitable shape, such as, for example, cylindrical. FIG. 2 is a top view of a device 10 without the casing in an open position according to various embodiments. In some embodiments, device 10 has a lever 14. In some embodiments, covering (or integral therewith) the lever 14 is a handgrip 56 (e.g. FIG. 5). In various embodiments, device 10 has a handle 12, which is operatively coupled to a base or platform 16. In various embodiments, base or platform 16 has a first surface opposing a second surface. In various embodiments, an elongated handle 12 extends from platform or base 16. In various embodiments, one of the opposing surfaces of platform or base 16 is configured to be disposed over an outer circumferential edge 160 of a top surface (e.g., 152, FIG. 15, 202 FIG. 19) of a can (e.g. 150, FIG. 15, 200, FIG. 19).

Figure 3:
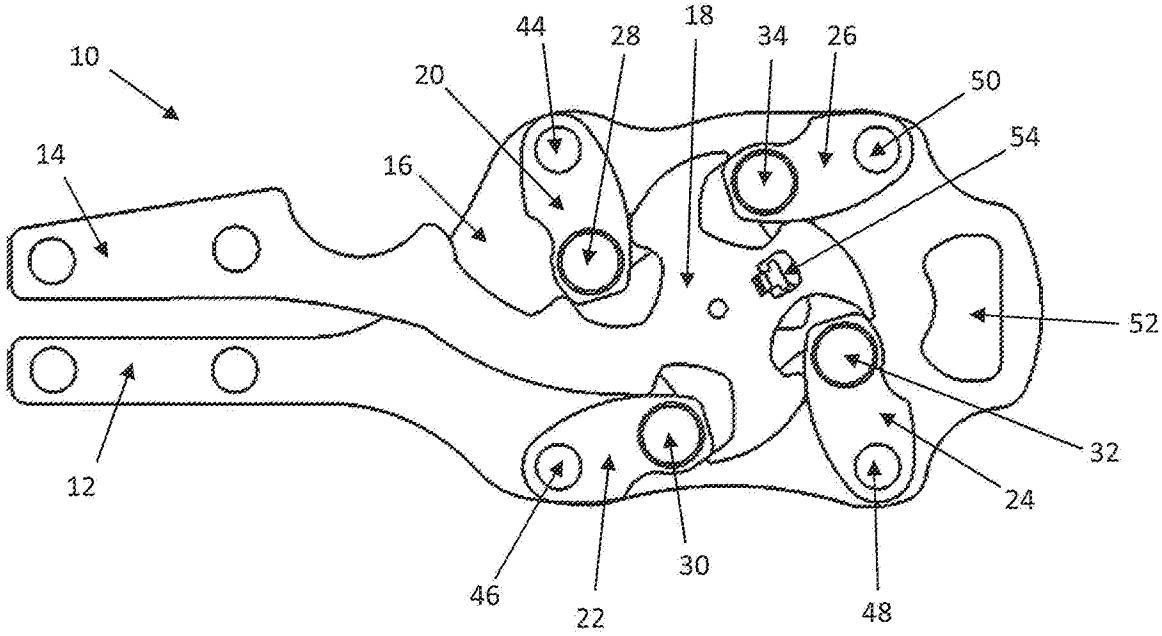
FIG. 3 is a bottom view of the device of FIG. 1 in a closed position in accordance with some embodiments of the present disclosure.
Figure 4:
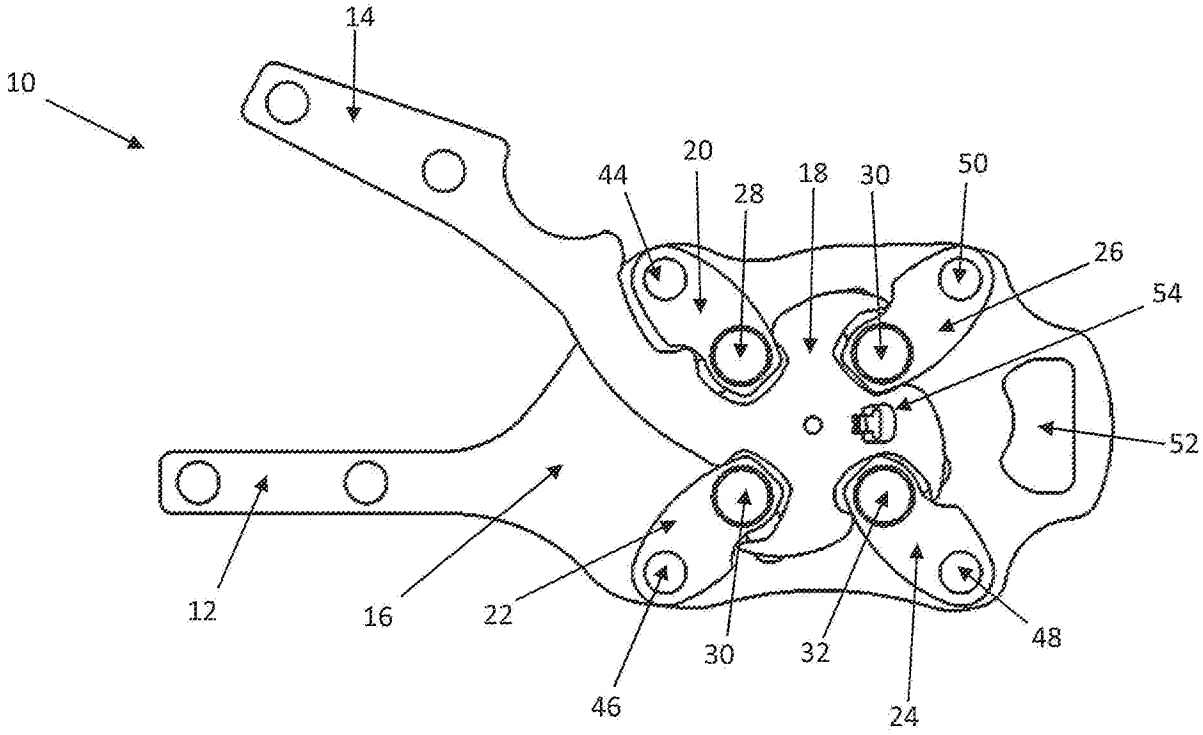
FIG. 4 is a bottom view of the device of FIG. 1 in an open position in accordance with some embodiments.

FIG. 3 is a bottom view of a device 10 without a casing in a closed position. FIG. 4 is a bottom view of a device without a casing in an open position. In some embodiments, device 10 may be a can opener. In various embodiments, a plurality of arms 20, 22, 24, 26 are operatively coupled to a surface of platform or base 16. In some embodiments, operatively coupled to the underside of the base or platform 16 are four arms that protrude inward from the each of the four corners of the platform 16, namely the first arm 20, the second arm 22, the third arm 24, and the fourth arm 26. In various embodiments, each of the plurality of arms 20, 22, 24, 26 has a respective blade 28, 30, 32, 34 operatively coupled to a respective portion of the respective arm. In some embodiments, operatively coupled to the approximate end of each arm 20, 22, 24, 26 is a blade 28, 30, 32, 34. In various embodiments, arm 20 holds the first blade 28, arm 22 holds the second blade 30, arm 24 holds the third blade 32, and arm 26 holds the fourth blade 34. In various embodiments, lever 14 is operatively coupled to platform or base 16 and to each of the plurality of arms 20, 22, 24, 26 such that movement of the lever 14 towards the handle 12 rotates each of the plurality of arms 20, 22, 24, 26 to extend each respective blade 28, 30, 32, 34 outward from the center of platform or base 16.

In some embodiments, a clip 36, 38, 40, 42 (e.g. FIG. 2) is operatively coupled to a top of each blade 28, 30, 32, 34. In some embodiments, each clip 36, 38, 40, 42 is configured to hold a respective blade 28, 30, 32, 34 in place, but is further configured to allow each respective blade 28, 30, 32, 34 to rotate three hundred and sixty degrees. According to various embodiments, a first blade 28 is operatively coupled to a first clip 36, a second blade 30 is operatively coupled to a second clip 38, a third blade 32 is operatively coupled to a third clip 40, and a fourth blade 34 is operatively coupled to a fourth clip 42. In some embodiments, towards each corner of platform or base 16 are respective connectors 44, 46, 48, 50, each of which is configured to hold a respective arm 20, 22, 24, 26 in place but are further configured to allow the arms 20, 22, 24, 26 to rotate. In various embodiments, arm 20 is operatively coupled to connector 44, arm 22 is operatively coupled to connector 46, arm 24 is operatively coupled to connector 48, and arm 26 is operatively coupled to connector 50. In various embodiments, each respective blade 28, 30, 32, 34 is configured to engage a respective portion of an inner circumferential edge (e.g. 154, FIG. 15) of a container (e.g. can 150, 200) when lever 14 is moved toward the surface of platform or base 16 is disposed over an outer circumferential edge (e.g. 160, FIG. 15) of a top surface of the container (e.g. can 150, 200). In various embodiments, movement of lever 14 toward handle 12 engages each respective blade 28, 30, 32, 34 with a respective portion of an inner circumferential edge (e.g. 154, FIG. 15) of a container (e.g. can 150, 200).

In various embodiments, device 10 includes a gear 18 operatively coupled to lever 14 and a respective portion of each of said plurality of arms 20, 22, 24, 26 such that movement of lever 14 toward handle 12 rotates gear 18 to rotate each respective plurality of arms 20, 22, 24, 26, to extend each respective blade 28, 30, 32, 34 outward from the center of platform or base 16. In some embodiments, lever 14 is operatively coupled to a gear 18. In some embodiments, when lever 14 is squeezed toward handle 12, gear 18 operatively coupled to lever 14 rotates approximately thirty degrees (e.g. between twenty-five and thirty-five degrees). In various embodiments, a portion of lever 14 is configured to engage a lip of a cap disposed on a bottle. In some embodiments, an end of platform or base 16 is operatively coupled to a bottle opener 52. In various embodiments, a capture device 54 such as, for example, a hook or magnet, is operatively coupled to a surface of platform or base 16 to maintain engagement with a top surface (e.g. 152, 156) of a container (e.g. can 150, 200). In various embodiments, capture device 54 is operatively coupled to a surface of platform or base 16 to remove a top of the container. In some embodiments, movement of lever 14 toward handle 12 compresses a spring 125 so that the lever 14 returns to the fixed starting position after movement.

Figure 5:
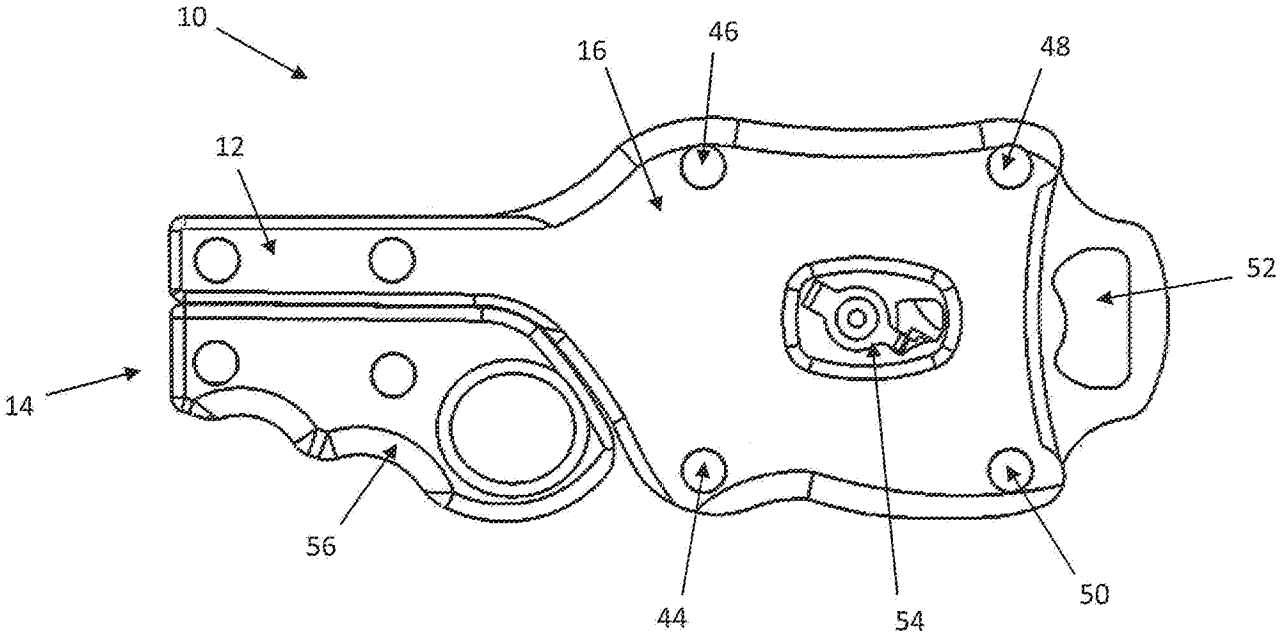
FIG. 5 is a top view of a container opening device in a closed position in accordance with some embodiments of the present disclosure.
Figure 6:
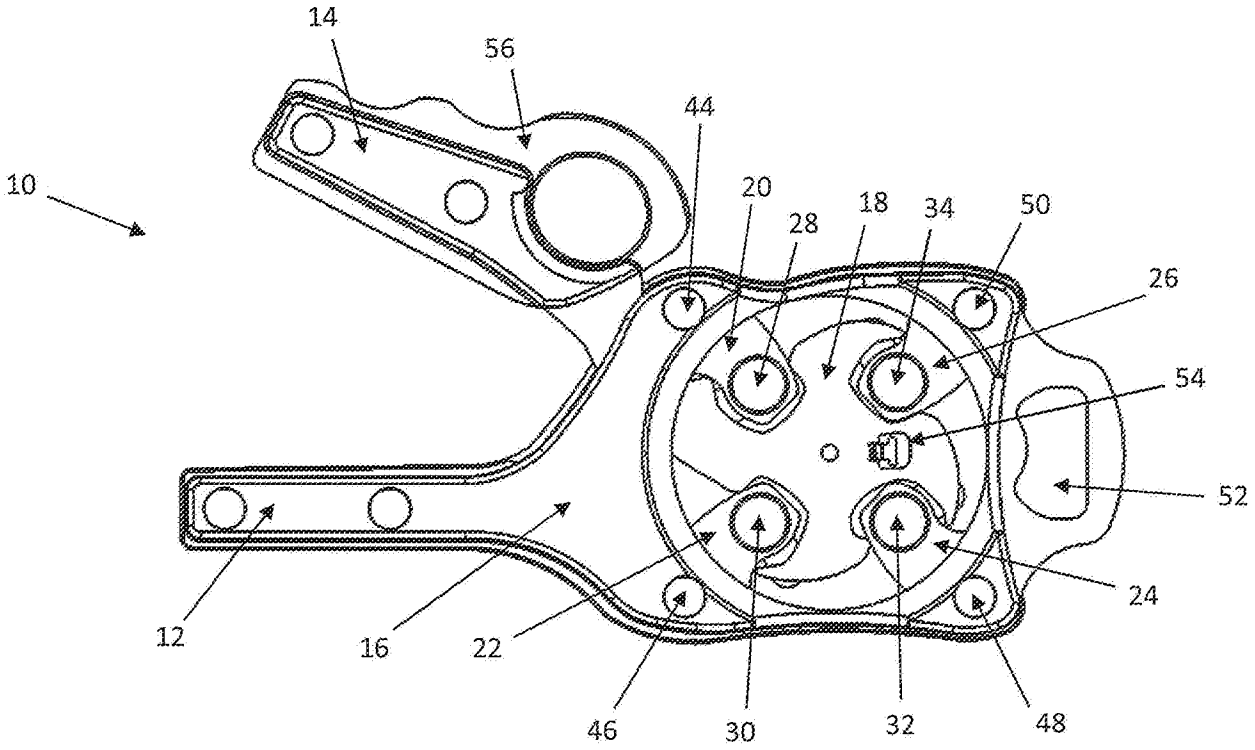
FIG. 6 is a bottom view of the device of FIG. 5 in an open position in accordance with some embodiments of the present subject matter.
Figure 7:
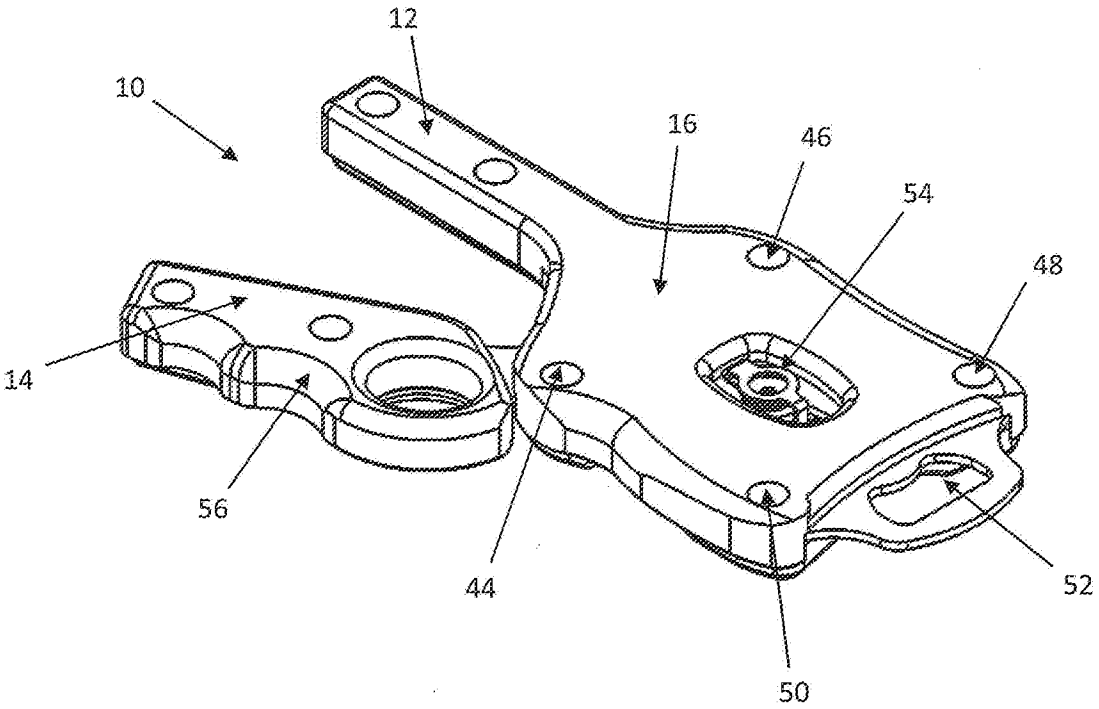
FIG. 7 is a top perspective view of the device of FIG. 5 in an open position in accordance with some embodiments of the present disclosure.
Figure 8:
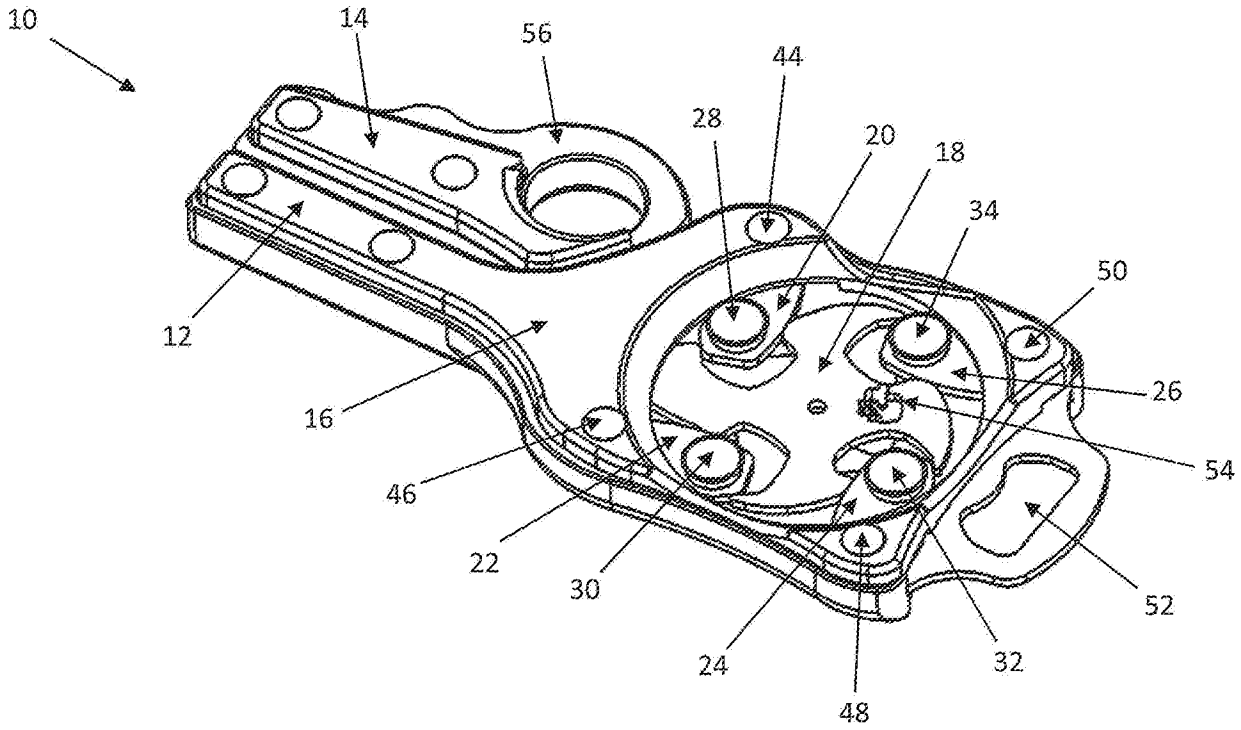
FIG. 8 is a bottom perspective view of the device of FIG. 5 in a closed position in accordance with some embodiments.
Figure 9:
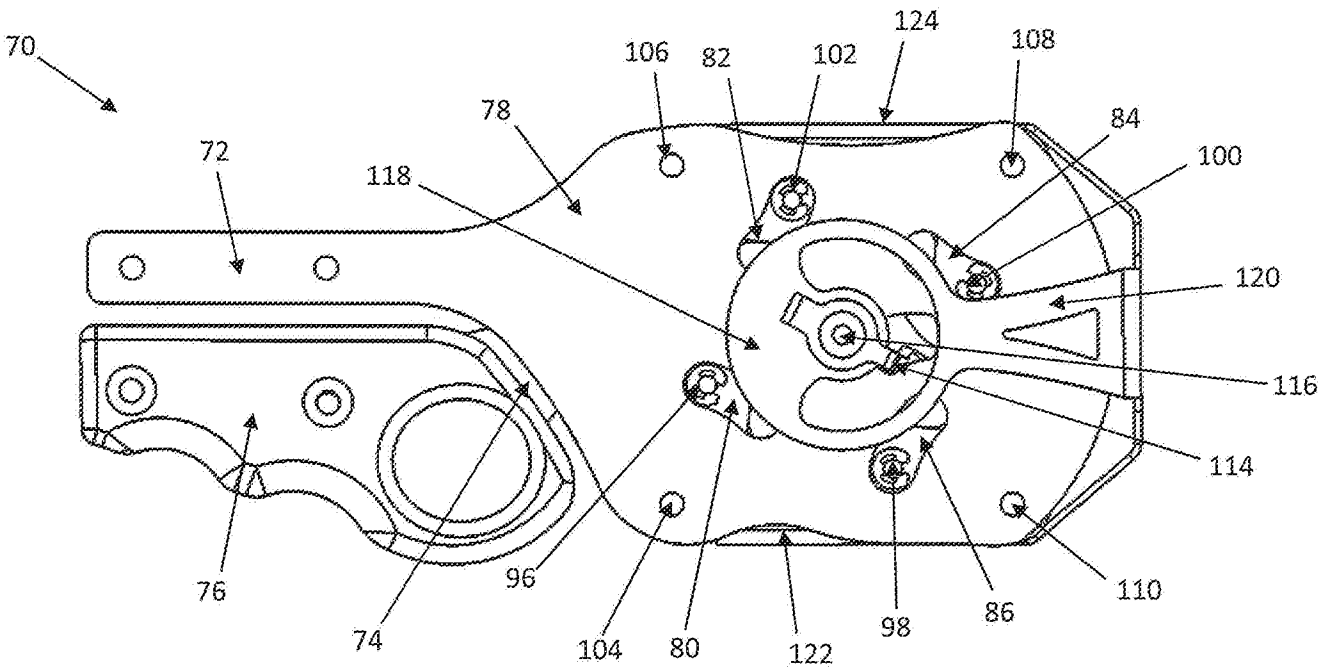
FIG. 9 is a top view of a container opening device in a closed position in accordance with some embodiments of the present disclosure.
Figure 10:
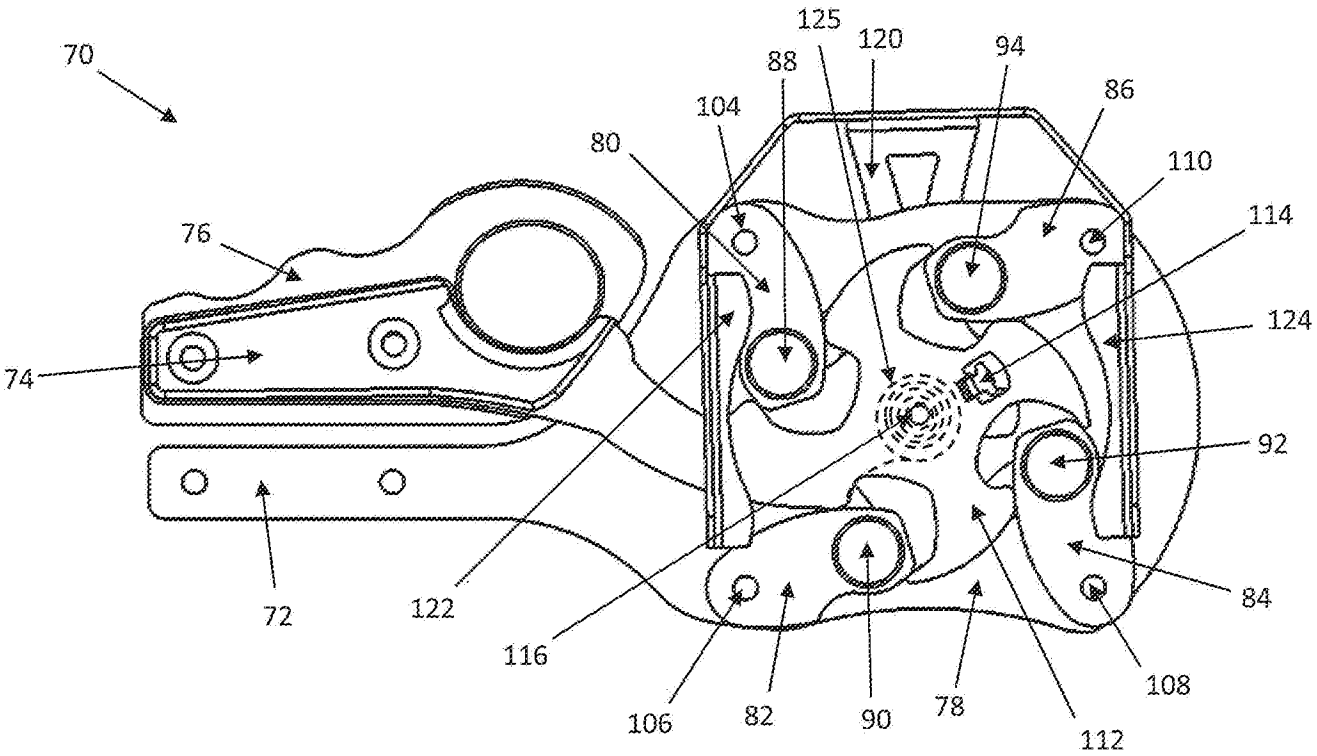
FIG. 10 is a bottom view of the device of FIG. 9 in a closed position in accordance with some embodiments of the present disclosure.
Figure 11:
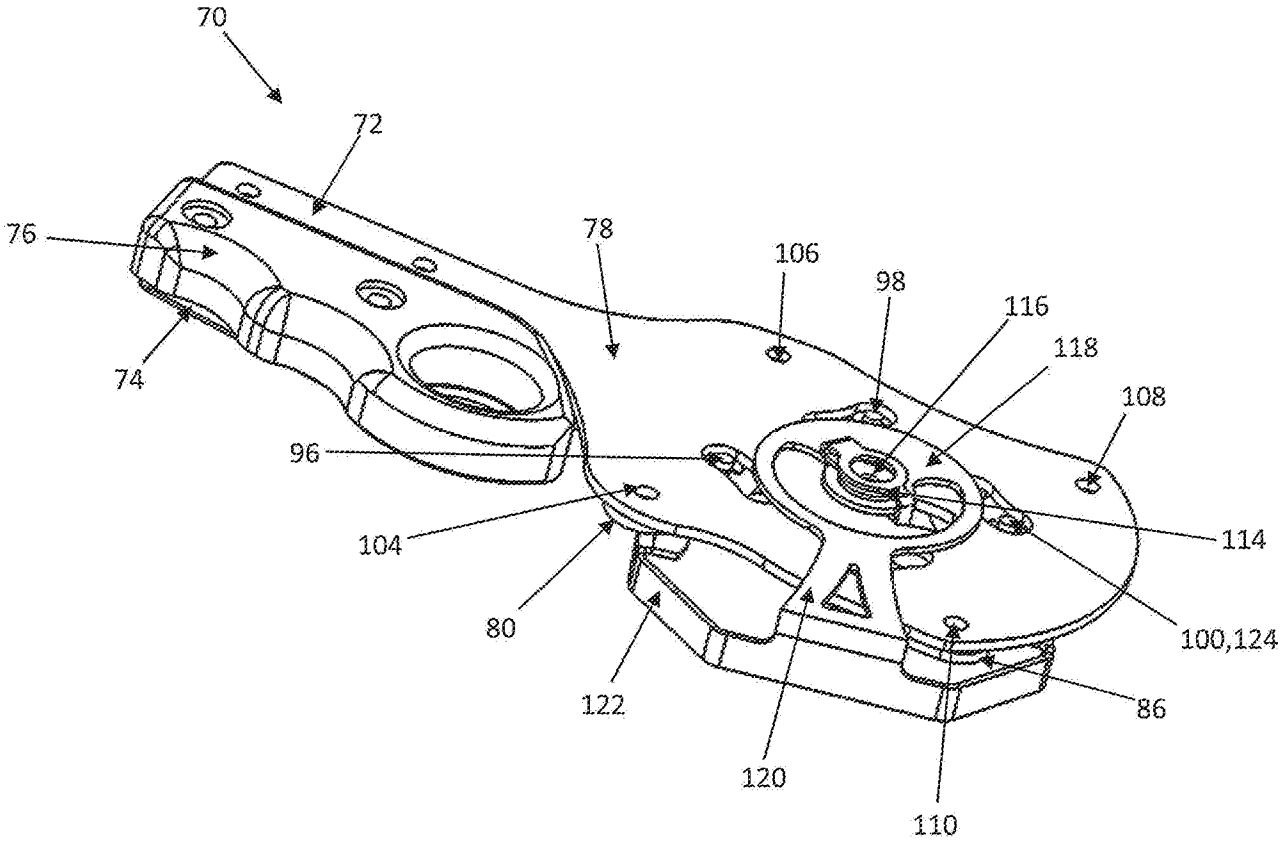
FIG. 11 is a top perspective view of the device of FIG. 9 in a closed position in accordance with some embodiments.
Figure 12:
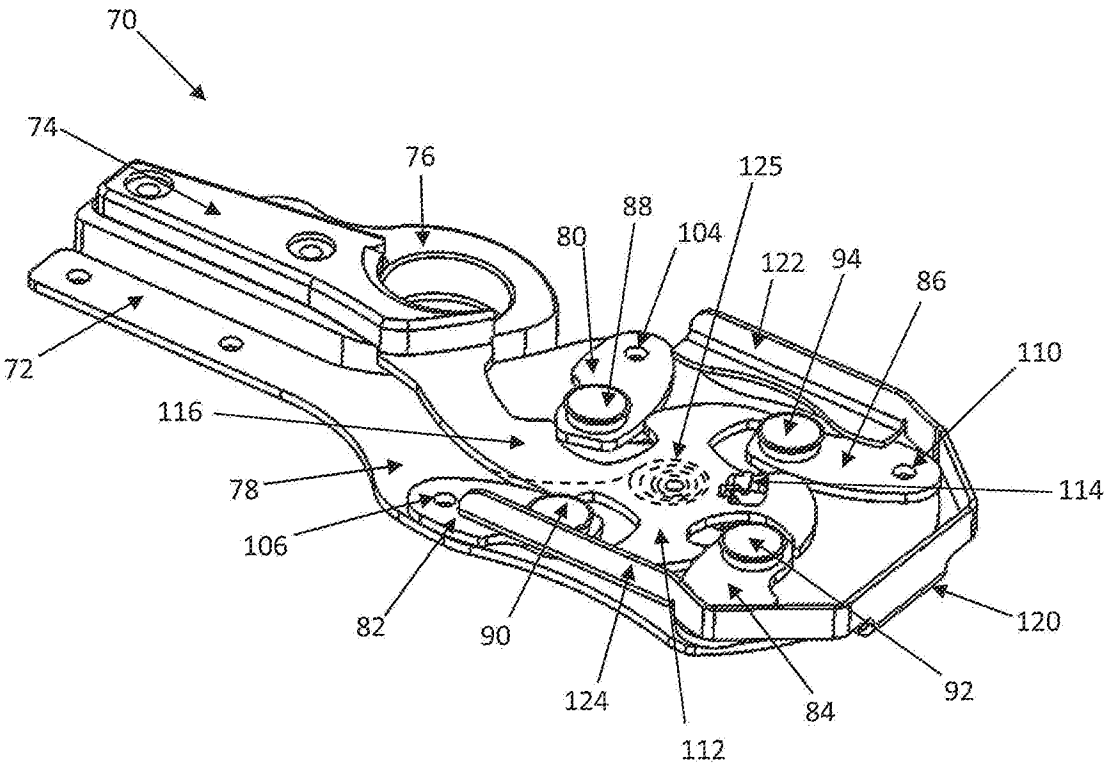
FIG. 12 is a bottom perspective view of the device of FIG. 9 in a closed position in accordance with some embodiments of the present disclosure.

FIG. 5 is a top view of an embodiment of a container opening device with a casing in a closed position. FIG. 6 is a top view of a device 10 with a casing in an open position. In some embodiments, device 10 may be a can opener. In some embodiments, device 10 has a base or platform 16 wide enough to rest over the edges (e.g. circumferential edges) of a beverage can 150 or a standard food can 200 when placed on the top surface 152 or 202 of can 150 or 200. In some embodiments, device 10 also has a handle 12 and a lever 14. In various embodiments, a portion of lever 14 includes a plurality of grooves (FIG. 5). In some embodiments, the lever 14 has a handgrip 56. In some embodiments, a plurality of grooves included on a portion of lever 14 form a handgrip. In various embodiments, device 10 includes a plurality of arms 20, 22, 24, 26. In various embodiments, each of the arms 20, 22, 24, 26 is rotatably coupled to a surface of base or platform 16 at one respective end and includes a respective blade 28, 30, 32, 34 disposed at a respective opposing end. In various embodiments, lever 14 is operatively coupled to base or platform 16 and the respective opposing end of each of the plurality of arms 20, 22, 24, 26 such that, when lever 14 is in an open position, each respective opposing end of the plurality of arms 20, 22, 24, 26 is proximate a center of base or platform 16 and, when lever 14 is operated toward a closed position, each respective opposing end of the plurality of arms 20, 22, 24, 26 is rotated outward from the center of base or platform 16. In various embodiments, each respective blade 28, 30, 32, 34 is configured to engage a respective portion of an inner circumferential edge 154 of a container (e.g. beverage can 150 or standard food can 200) when lever 14 is operated toward a closed position and a surface of base or platform 16 is disposed over an outer circumferential edge 160 of a top surface (e.g. 152, 202) of the container. In some embodiments, movement of lever 14 toward handle 12 compresses a spring 125 so that the lever 14 returns to a starting position after lever 14 is released.

Figure 18:
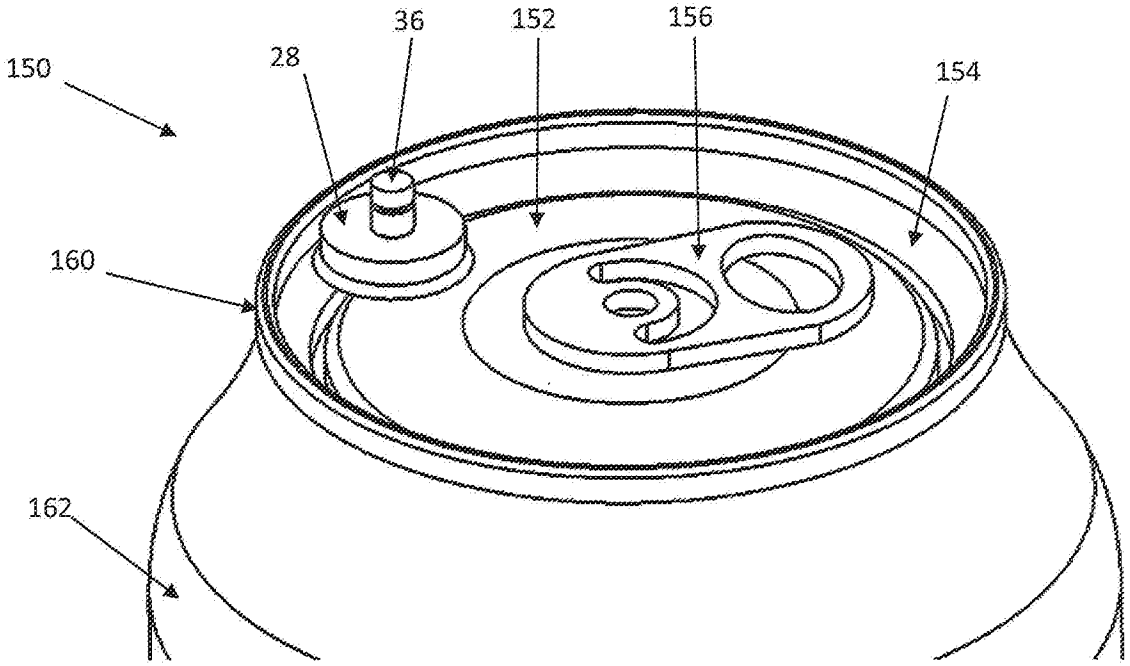
FIG. 18 is a perspective view of the top surface of a container showing the placement of a single blade on a portion of an inner circumferential edge in accordance with some embodiments of the present disclosure.

In various embodiments, device 10 includes a gear 18 operatively coupled to lever 14 and a respective end of each of the plurality of arms 20, 22, 24, 26 and gear 18 is configured to rotate when lever 14 is operated toward a closed position. In various embodiments, when handgrip 56 on lever 14 is pulled towards handle 12, gear 18 rotates a predetermined amount of degrees (e.g. about thirty degrees (e.g. between twenty-five and thirty-five degrees)), which in turn, pivots arms 20, 22, 24, 26 until each blade 28, 30, 32, 34 punctures the inner rim 154 (e.g. inner circumferential edge) of the container (e.g. beverage can 150 or standard food can 200). FIG. 18 is a perspective view of the top surface of a container (e.g. beverage can 150 or standard food can 200) showing the engagement of a representative single blade with a portion of an inner circumferential edge in accordance with some embodiments. In some embodiments, device 10 is then turned approximately ninety degrees, with respect to the container (e.g. beverage can 150 or standard food can 200), while maintaining pressure on handle 12 and lever 14, so that blades 28, 30, 32, 34 cut the inner rim 154 (e.g. inner circumferential edge) of can 150. In some embodiments, the container (e.g. beverage can 150 or standard food can 200) is rotated approximately ninety degrees, with respect to device 10, while maintaining pressure on handle 12 and lever 14, so that blades 28, 30, 32, 34 cut the inner rim 154 (e.g. inner circumferential edge) of can 150. In some embodiments, device 10 is rotated approximately ninety degrees, with respect to the container (e.g. beverage can 150 or standard food can 200), while maintaining lever 14 adjacent handle 12, so that blades 28, 30, 32, 34 cut the inner rim 154 (e.g. inner circumferential edge) of the container (e.g. beverage can 150 or standard food can 200). In various embodiments, each respective blade 28, 30, 32, 34 is further configured to cut along the inner circumferential edge 154 of the container (e.g. beverage can 150 or standard food can 200) when lever 14 is operated toward a closed position and a surface of base or platform 16 is disposed over the outer circumferential edge 160 of the top surface 152 of the container (e.g. beverage can 150 or standard food can 200). In various embodiments, a capture device 54 is operatively coupled to base or platform 16.

Figure 13:
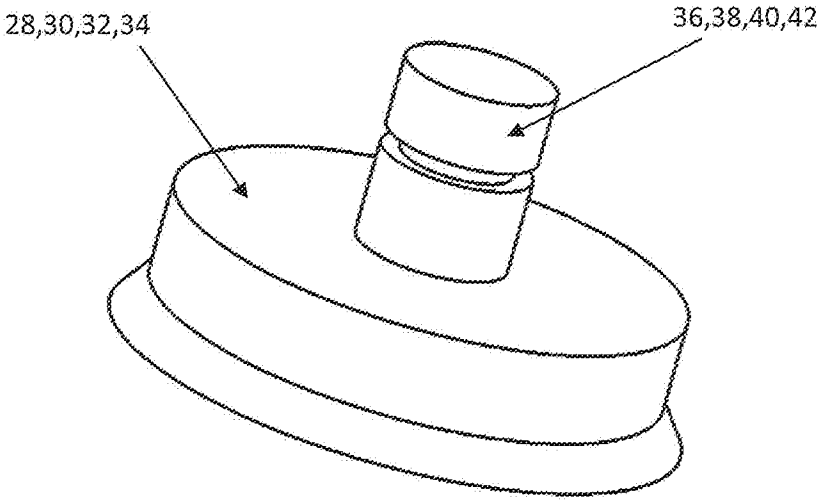
FIG. 13 is a perspective view of a blade from a container opening device in accordance with some embodiments of the present subject matter.
Figure 14:
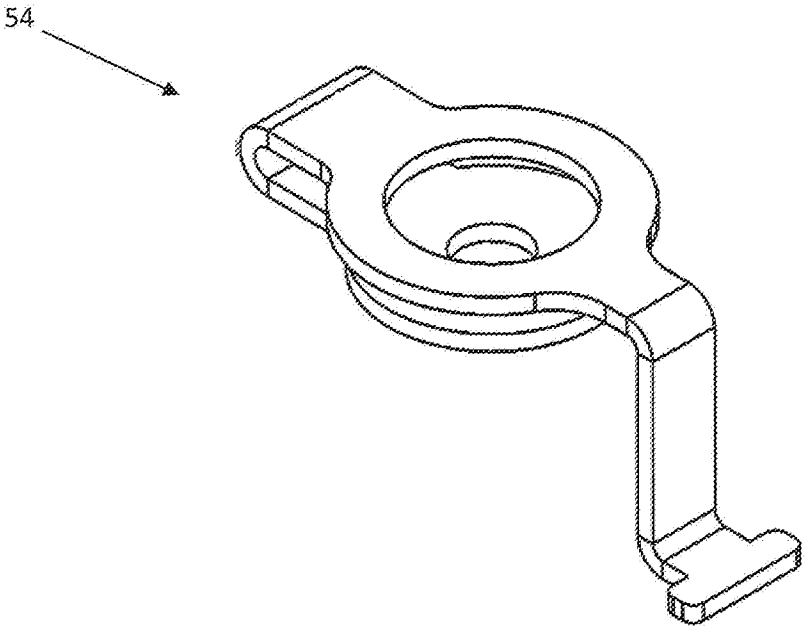
FIG. 14 is a perspective view of a capture device portion of a container opening device in accordance with some embodiments of the present disclosure.
Figure 17:
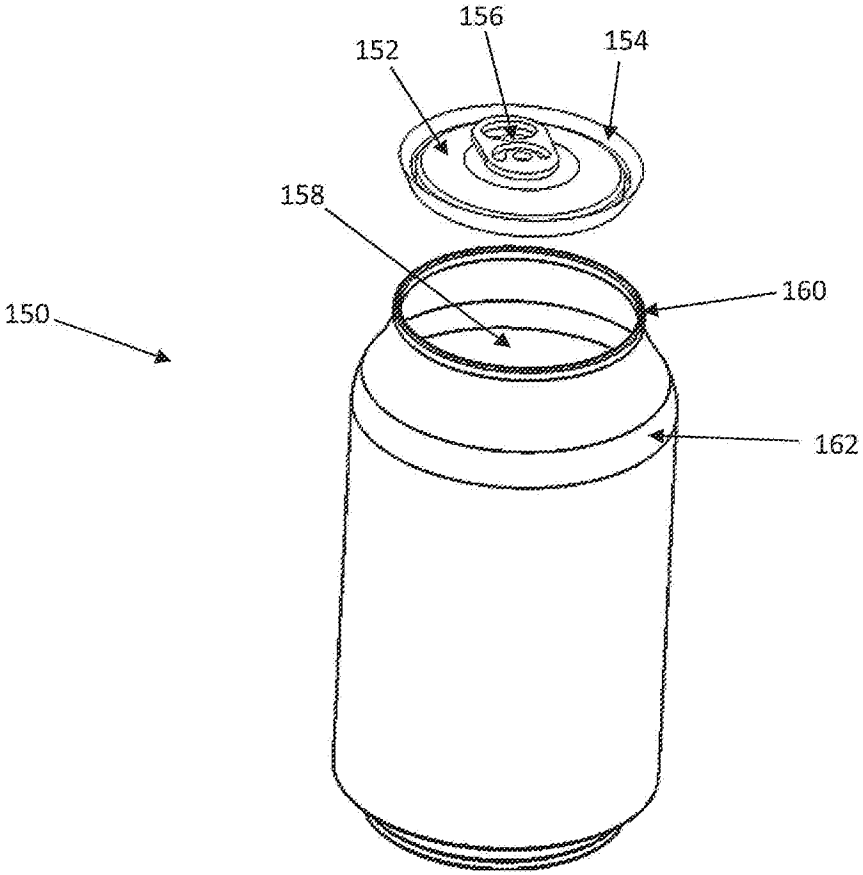
FIG. 17 is a perspective view of a container with the top surface removed in accordance with some embodiments of the present disclosure.

FIG. 13 is a perspective view of a blade of a container opening device in accordance with some embodiments. FIG. 14 is a perspective view of a capture device portion of a container opening device in accordance with some embodiments. In various embodiments, capture device 54 is configured to maintain engagement with a top surface (e.g. 152, 202) of a container (e.g. can 150, 200). In various embodiments, a capture device 54 such as, for example, a hook or magnet, is operatively coupled to a surface of platform or base 16 to maintain engagement with a top surface (e.g. 152, 156, 202) of a container (e.g. can 150, 200). In some embodiments, as blades 28, 30, 32, 34 make their cut, capture device or hook 54 grabs tab 156 disposed at a top surface of can 152. Thus, when blades 28, 30, 32, 34 finish making their cut along the inner rim 154, the top surface 152 of can 150 may be removed and the capture device or hook 54 may hold the cut top surface 152 by can's 150 tab 156 preventing it from falling into the now exposed contents 158 of can 150. FIG. 17 is a perspective view of a container with the top surface removed as described in various embodiments. When top surface 152 is removed, the outer rim 160 of can 150 will remain.

The construction details according to some embodiments as shown in FIG. 1 through FIG. 8, is suitably wide enough to rest on top of a beverage can 150 with the edges of platform 16 expanding past the edges of the pressed outer rim 160 of can 150. In some embodiments, device 10 is approximately 3 to 5 inches wide. In some embodiments, the length of device 10 is long enough to allow for leverage when blades 28, 30, 32, 34 make their cut of inner rim 154 of can 150. In some embodiments, device 10 is approximately 5 to 7 inches (e.g. 4.5 to 7.5 inches) long. In some embodiments, device 10 is approximately 0.5 to 1 (e.g. 0.4 to 1.1 inches) inch thick for easy storage.

According to some embodiments as shown in FIG. 1 through FIG. 12, and FIG. 20 through FIG. 26, device 10 may be made of metal, high-strength plastic, or of any other suitably rigid and strong material. In some embodiments, to achieve a proper cut, blades 28, 30, 32, 34 are made of any metal harder than aluminum with corrosion resistant properties.

According to some embodiments, as shown in FIG. 9 through FIG. 12, device 70 has a handle 72, and a lever 74. In some embodiments, device 70 may be a can opener. In some embodiments, covering lever 74 (or integrally formed therewith) is a handgrip 76. Handle 72 is operatively coupled to a base or platform 78. In some embodiments, a surface (e.g. underside) of platform 78 is operatively coupled to four arms that protrude inward from each of the four corners of platform 78. According to some embodiments, platform 78 is operatively coupled to a first arm 80, a second arm 82, a third arm 84, and a fourth arm 86. In some embodiments, the approximate end of each arm 80, 82, 84, 86 is operatively coupled to a blade 88, 90, 92, 94. In some embodiments, arm 80 holds the first blade 88, arm 82 holds the second blade 90, arm 84 holds the third blade 92, and arm 86 holds the fourth blade 94.

In some embodiments, a top of each blade 88, 90, 92, 94 is operatively coupled to a clip 96, 98, 100, 102, each of which is configured to hold a respective blade 88, 90, 92, 94 in place and is further configured to allow the respective blade 88, 90, 92, 94 to rotate three hundred and sixty degrees. According to some embodiments, first blade 88 is operatively coupled to first clip 96, second blade 90 is operatively coupled to second clip 98, third blade 92 is operatively coupled to third clip 100, and fourth blade 94 is operatively coupled to fourth clip 102. In some embodiments, towards each corner of the platform 78 are connectors 104, 106, 108, 110, which are configured to hold arms 80, 82, 84, 86 in place and are further configured to allow arms 80, 82, 84, 86 to rotate. In some embodiments, arm 80 is operatively coupled to connector 104, arm 82 is operatively coupled to connector 106, arm 84 is operatively coupled to connector 108, and arm 86 is operatively coupled to connector 110. In some embodiments, lever 74 is operatively coupled to gear 112. In some embodiments, lever 74 and gear 112 are configured so that when lever 74 is squeezed toward a closed position, gear 112 rotates a predetermined amount of degrees (e.g. approximately thirty degrees (e.g. between twenty-five and thirty-five degrees))

such that each respective blade 88, 90, 92, 94 punctures the inner rim 154 (e.g. inner circumferential edge) of a container 200 or can 150. In some embodiments, platform 78 includes, or a surface of platform 78 is operatively coupled to, a capture device such as hook 114, near the center of platform 78. In some embodiments, a pin 116 located in the center of platform 78 is operatively coupled to a ring 118 which is configured to rotate one hundred and eight degrees. In some embodiments, ring 118 is operatively coupled to a limb 120 configured to hold two clamps 122, 124 on the underside of platform 78. In some embodiments, a spring 125 is configured to compress when lever 14 is squeezed toward a closed position, so that lever 14 returns to fixed starting position after such compression is released.

According to some embodiments, as shown in FIG. 9 through FIG. 12, device 70 has a platform 78 wide enough to rest over the circumferential edges of a beverage can 150 or a standard food can 200 when placed on the top surface 152 or 202. In some embodiments, device 70 further comprises a handle 72 and a lever 74. In some embodiments, movement of handgrip 76 toward lever 74 rotates gear 112 a predetermined amount of degrees (e.g. approximately thirty degrees (e.g. between twenty-five and thirty-five degrees)), which in turn, pivots arms 80, 82, 84, 86 until each blade 88, 90, 92, 94 punctures a portion of inner rim 154 of can 150. In some embodiments, movement of lever 74 toward the platform 78 rotates gear 112 a predetermined amount of degrees (e.g. approximately thirty degrees (e.g. between twenty-five and thirty-five degrees)), which in turn, pivots arms 80, 82, 84, 86 until each blade 88, 90, 92, 94 punctures a portion of inner rim 154 of can 150. In some embodiments, clamps 122, 124 grip upper edges 162 of can 150 to create more leverage. In some embodiments, ring 118 holds limb 120 and clamps 122, 124 are configured to rotate one hundred and eighty degrees. In some embodiments, an operator may turn device 70 turned approximately ninety degrees (e.g. between eighty-five and ninety-five degrees) while maintaining pressure on handle 72 and lever 74 with one hand as well as maintaining pressure on clamps 122, 124 with an opposite hand, so that blades 88, 90, 92, 94 cut inner rim 154 of can 150 with the least amount of force needed. As blades 88, 90, 92, 94 are making their cut, hook 114 may grab tab 156 located on a top surface of can 152. In some embodiments, when each of blades 88, 90, 92, 94 finishes making its respective cut, the top surface 152 of can 150 may be removed with hook 114 configured to hold the cut top surface 152 by tab 156 to prevent top surface 152 from falling into the now exposed contents 158 of can 150. In some embodiments, when top 152 is removed, pressed outer rim 160 of can 150 will remain.

According to some embodiments as shown in FIG. 9 through FIG. 12, device 70 is sufficiently wide enough to rest on a top surface 152 of a beverage can 150 with the edges of platform 78 expanding past the edges of the pressed outer rim 160 of can 150. In some embodiments, device 70 is approximately 3 to 5 inches wide. In some embodiments, the length of device 70 is long enough to allow for leverage when blades 88, 90, 92, 94 are making their cuts of the inner rim 154 of can 150. In some embodiments, device 70 is approximately 5 to 7 inches (e.g. 4.5 to 7.5 inches) long. In some embodiments, device 70 is approximately 0.5 to 1 inch (e.g. 0.4 to 1.1 inches) thick for easy storage.

According to some embodiments, device 70 may be made of metal, high-strength plastic, or any suitably rigid and strong material. In some embodiments, to achieve the proper cut, blades 88, 90, 92, 94 may be made of a metal harder than aluminum with corrosion resistant properties. In some embodiments, clamps 122, 124 may be made of metal, high-strength plastic, or of any suitably rigid and strong material but allowed to bend slightly to provide sufficient grip on upper edges 162 of can 150.

The inventors have determined that apparatus and methods provided herein may achieve advantages including, for example, providing an apparatus that is able to adhere to the different sizes and contours of containers (e.g. beverage can 150, food can 200). The inventors have also determined that apparatus and methods provided herein may allow the user to safely remove the top surface (e.g. 152, 202) of a container (e.g. 150, 200) with both ease and efficiency. In various embodiments, a device provided herein has multiple blades (e.g. 88, 90, 92, 94) which may permit removal of the top surface (e.g. 152, 202) of a container (e.g. 150, 200) in a shorter amount of time with a more accurate cut. In some embodiments, the plurality of blades 88, 90, 92, 94 of a device provided herein are designed to fold the edges of the cut container material (e.g. aluminum) inward during the cutting action, allowing the device to leave little to no sharp edges at the point of the cut. In some embodiments, the device is a multi-blade can opener having at least two blades that pivot to allow the user to open a multitude of different, sealed cans.

According to some embodiments, as shown in FIG. 20 to FIG. 26, device 204 is operatively coupled to a lever 228. In some embodiments, device 204 may be a can opener. In some embodiments, lever 228 is operatively coupled to a surface (e.g. the underside) of platform 226 by a bolt 214 which acts as a fulcrum for lever 228. In some embodiments, lever 228 is operatively coupled to a gear 248. According to some embodiments, when lever 228 is squeezed from the first (e.g. open) to the second (e.g. closed) position, gear 248 rotates a predetermined amount of degrees (e.g. approximately thirty degrees (e.g. between twenty-five and thirty-five degrees)). In various embodiments, a portion of lever 228 is configured to engage a lip of a cap disposed on a bottle. In some embodiments, lever 228 is operatively coupled to a bottle opener 230.

In some embodiments, a surface (e.g. the underside) of platform 226 is operatively coupled to four arms 232, 234, 236, and 238 that protrude inward from the each of four corners of platform 226. In some embodiments, the approximate end of each arm 232, 234, 236, 238 is operatively coupled to a blade 240, 242, 244, 246. Thus, according to some embodiments, arm 232 holds first blade 240, arm 234 holds second blade 242, arm 236 holds third blade 244, and arm 238 holds fourth blade 246. In some embodiments, a top portion of each blade 240, 242, 244, 246 is operatively coupled to a respective clip 216, 218, 220, 222 which is configured to hold the respective blades in place and are further configured to allow each blade 240, 242, 244, 246 to rotate three hundred and sixty degrees. In some embodiments, first blade 240 is operatively coupled to first clip 216, second blade 242 is operatively coupled to second clip 218, third blade 244 is operatively coupled to third clip 220, and fourth blade 246 is operatively coupled to fourth clip 222. In some embodiments, platform 226 is operatively coupled at each corner to bolts 206, 208, 210, 212, which are configured to hold arms 232, 234, 236, 238 in place and are further configured to allow arms 232, 234, 236, 238 to rotate. Thus according to various embodiments, arm 232 is operatively coupled to bolt 206, arm 234 is operatively coupled to bolt 208, arm 236 is operatively coupled to bolt 210, and arm 238 is operatively coupled to bolt 212. In various other embodiments, platform 226 is operatively coupled near its center to a hook or other capture device (e.g. magnet) to remove the top of the container.

Figure 27:
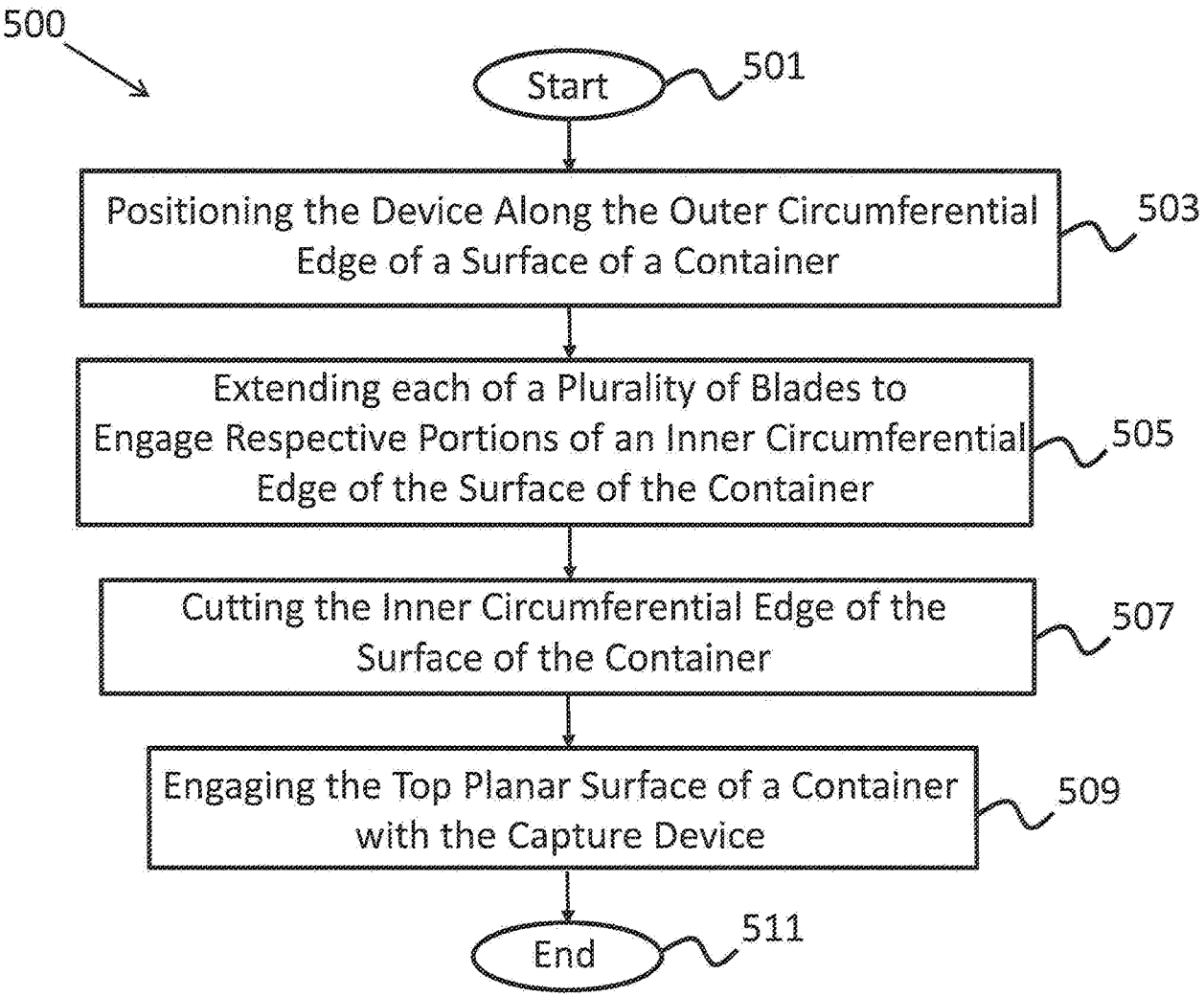
FIG. 27 is a flow chart of a method of removing the surface of a container in accordance with some embodiments of the present disclosure.
Figure 28:
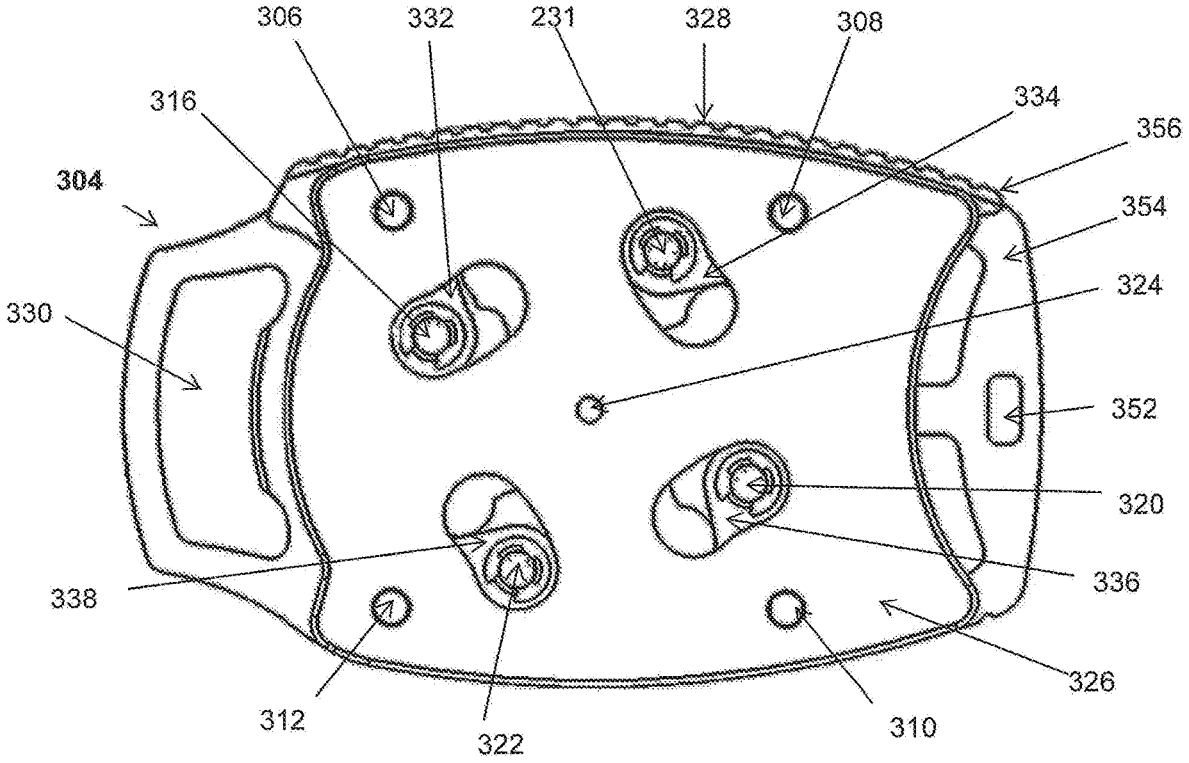
FIG. 28 is a top view of an embodiment of a container opening device.
Figure 29:
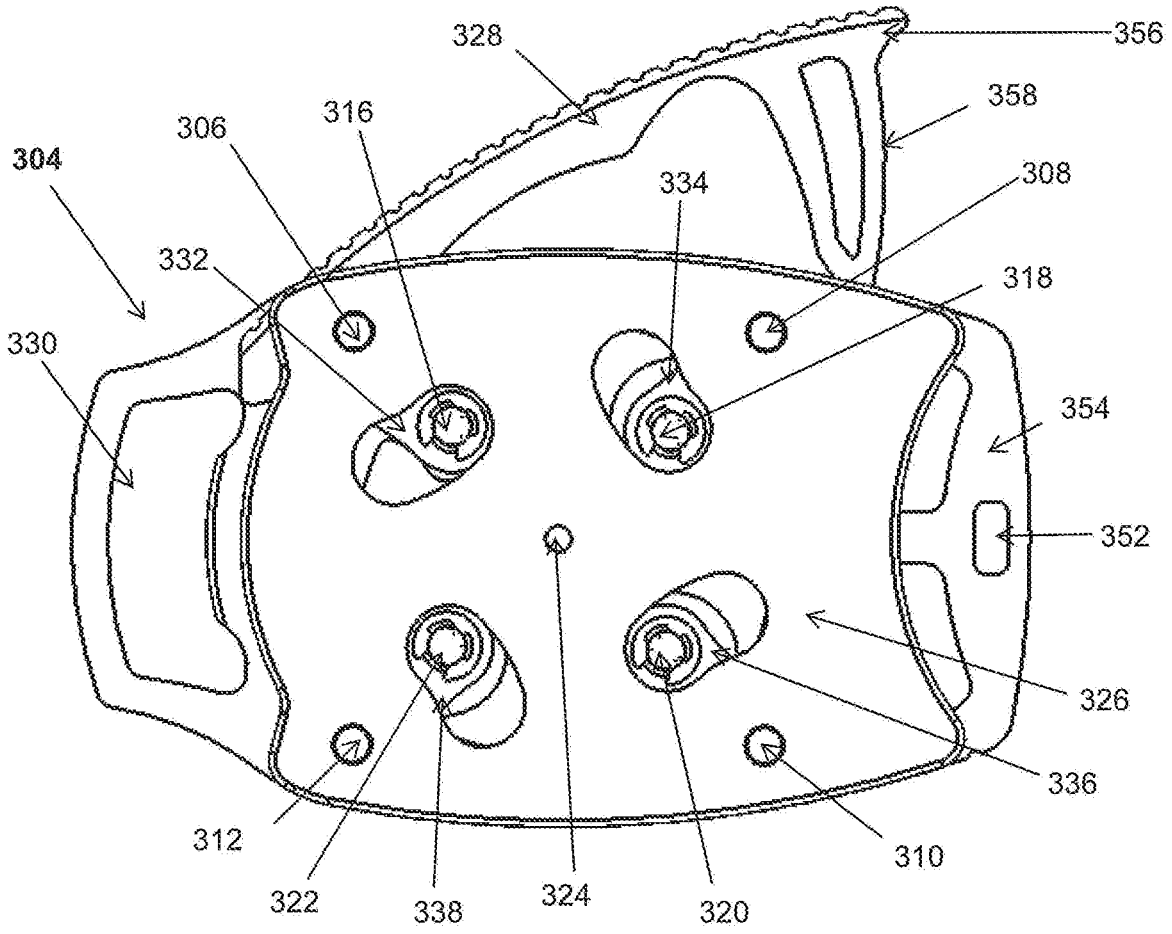
FIG. 29 is a top view of the container opening device of FIG. 28 in an open position.
Figure 30:
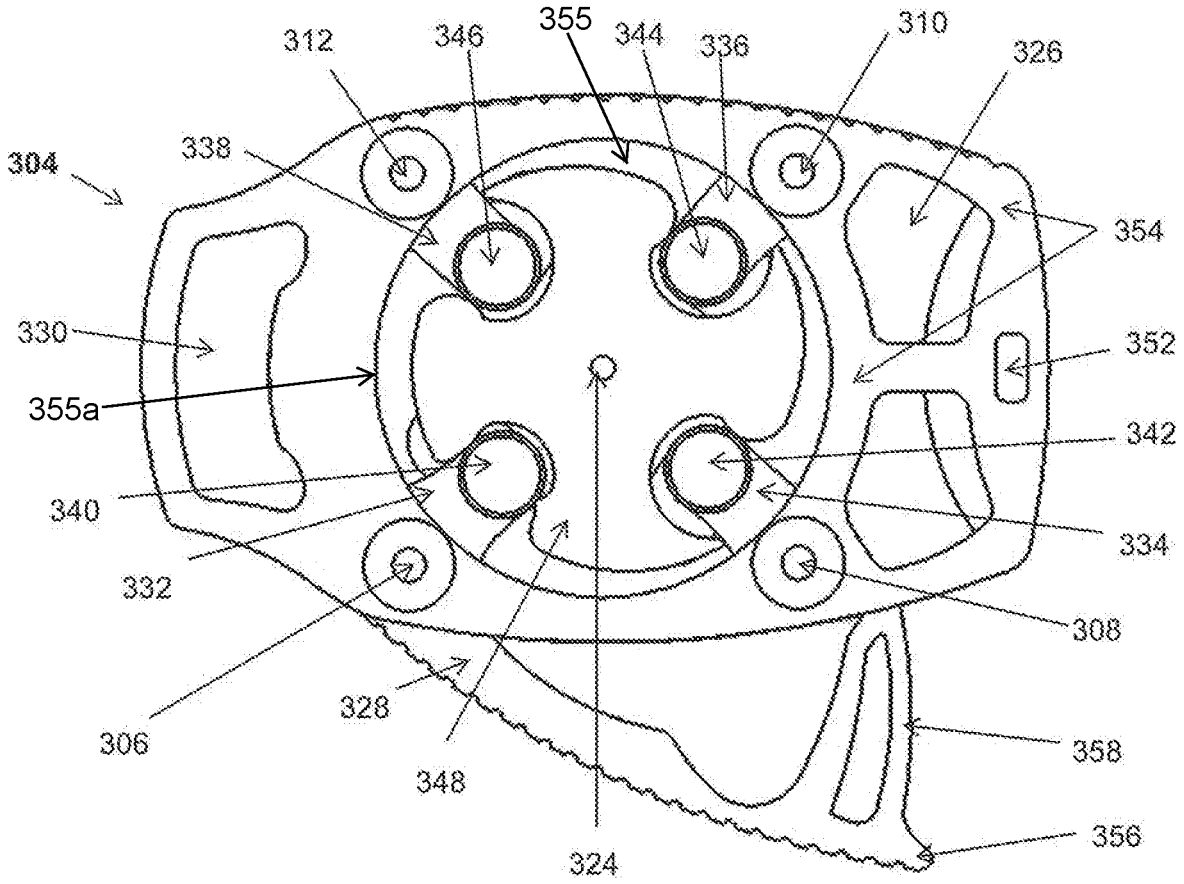
FIG. 30 is a bottom view of the container opening device of FIG. 28 in an open position.
Figure 31:
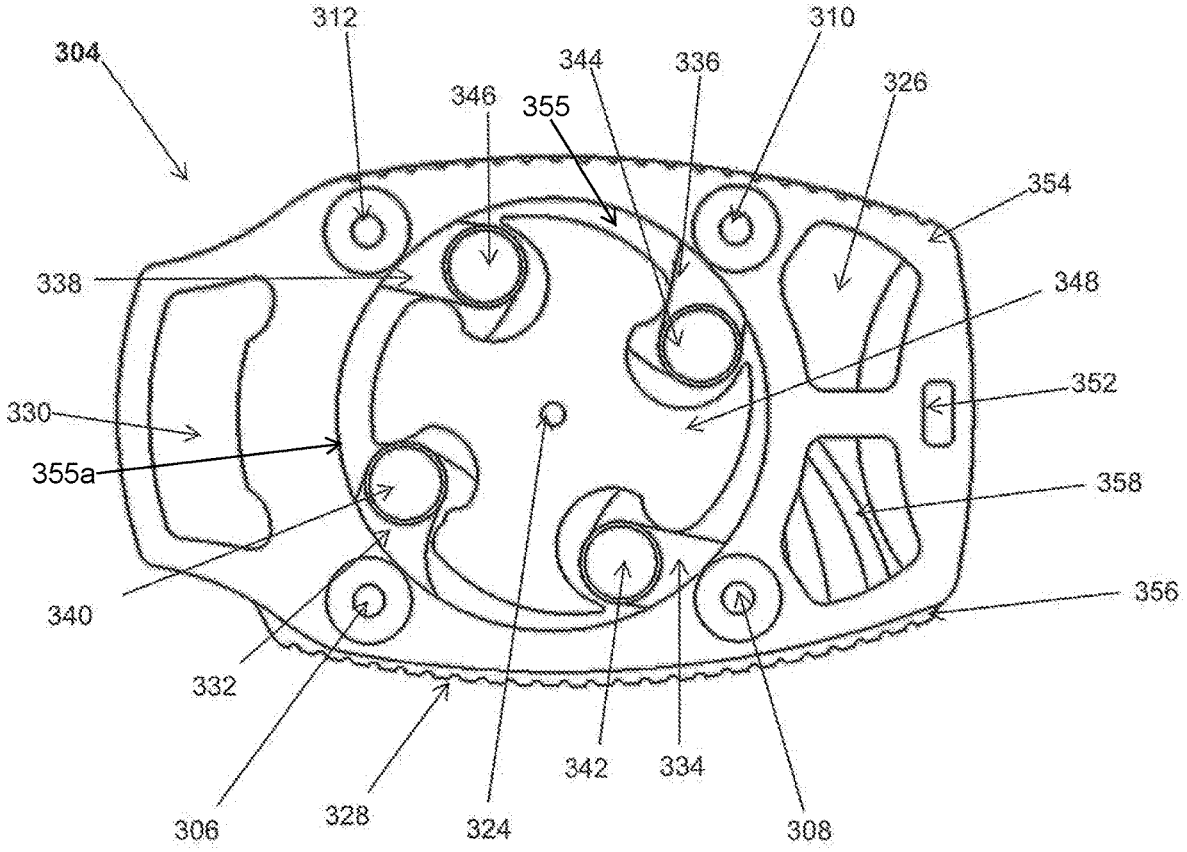
FIG. 31 is a bottom view of the container opening device of FIG. 28 in a closed position.

In some embodiments, device 204 provides an effective means of removing the planar top surface of a container. FIG. 27 is a flow chart of a method 500 of removing the surface of a container in accordance with some embodiments. Method 500 begins at block 501. At block 503, a surface of platform (e.g. 226) of a device (e.g. 204) is positioned over an outer circumferential edge of a surface (e.g. 152, 202) of a container (e.g. can 150, 200). At block 505, each of a plurality of blades (e.g. 240, 242, 244, 246) are extended to engage respective portions of an inner circumferential edge of the surface (e.g. 152, 202) of the container (e.g. can 150, 200) by compressing a lever (e.g. 228) of the device (e.g. 204). In various embodiments, compressing the lever (e.g. 228) of the device (e.g. 204) rotates respective arms (e.g. 232, 234, 236, 238) operatively coupled to the respective plurality of blades (e.g. 240, 242, 244, 246). In various embodiments, compressing the lever (e.g. 228) of the device (e.g. 204) rotates a gear (e.g. 248) operatively coupled to each of the plurality of blades (e.g. 240, 242, 244, 246). In various embodiments, compressing the lever (e.g. 228) of the device (e.g. 204) rotates a gear (e.g. 248) operatively coupled to each of a plurality of arms (e.g. 232, 234, 236, 238) that are operatively coupled to the respective plurality of blades (e.g. 240, 242, 244, 246).

At block 507, the inner circumferential edge of the surface of the container (e.g. can 150, 200) is cut by maintaining the lever (e.g. 228) compressed and rotating the platform of the device. In various embodiments, by rotating the platform of the device a predetermined amount of degrees, the entire inner circumferential edge of a surface (e.g. 152, 202) of the container (e.g. can 150, 200) will be cut such that the surface (e.g. 152, 202) of the container (e.g. can 150, 200) may be separated from the container (e.g. can 150, 200). In various embodiments, the predetermined amount of degrees is approximately ninety degrees (e.g. between eighty-five and ninety-five). The top planar surface (e.g. 152, 202) of the container (e.g. can 150, 200) engages a capture device portion of the device (e.g. 204) at block 509. In some embodiments, the capture device portion is a magnet. In some embodiments, the capture device portion is a hook. In the illustrated embodiment, method 500 ends at block 511.

FIGS. 28 to 31 illustrate another embodiment of a container opening device 304 similar to the device 204 described above. The container opening device 304 has a lever 328. The lever 328 is connected to the first arm 332 which is held in place between to the platform 326 and the base 354 by a bolt 306 which acts as the fulcrum of the lever 328. The lever 328 is hooked or attached to the gear 348 via the arm 332. When the lever 328 is squeezed from the open to the closed position, the gear 348 rotates approximately thirty degrees. At the end of the lever 328 is a punch 356 which has a guide 358 attached to it that slides between the platform 326 and the base 354. Attached between the platform 326 and the base 354 are four arms that protrude inward from the each of the four corners of the platform 326, namely the first arm 332, the second arm 334, the third arm 336, and the fourth arm 338. Connected at the approximate end of each arm 332, 334, 336, 338 is a respective blade 340, 342, 344, 346. Each of the blades 340, 342, 344, 346 is disposed within an opening 355 of the base 354 (shown in FIGS. 30 and 31). The opening 355 defines an inner face 355*a*. Arm 332 holds the first blade 340, arm 334 holds the second blade 342, arm 336 holds the third blade 344, and arm 338 holds the fourth blade 346. Connected to the top of each blade 340, 342, 344, 346 is a clip 316, 318, 320, 322 which holds the blade in place but allows each blade 340, 342, 344, 346 to rotate three hundred and sixty degrees. Namely the first blade 340 is connected to the first clip 316, the second blade 342 is connected to the second clip 318, the third blade 344 is connected to the third clip 320, and the fourth blade 346 is connected to the fourth clip 322. Towards each corner of the platform 326 are bolts 306, 308, 310, 312, which hold the arms 332, 334, 336, 338 in place but allow the arms 332, 334, 336, 338 to rotate. Namely, at their base, arm 332 is connected to bolt 306, arm 334 is connected to bolt 308, arm 336 is connected to bolt 310, and arm 338 is connected to bolt 312. Attached at one end of the base 354 is a bottle opener 330, and at the other end of the base 354 is a clip holder 352.

In embodiments, the punch 356 is used to push the top in if the cut was not perfect. The guide 358 can be used as a lever for the punch 356 by resting the guide 358 on the rim of the can (or other container) with the nose of the punch 356 facing down towards the can top. Moving the container opening device 304 forward while the guide 358 is resting on the rim of the can will move the punch 356 downward, allowing for pressure to push the top into the can so the user's fingers do not have to.

It may be emphasized that the above-described embodiments, are merely possible examples of implementations, and merely set forth a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure and the present disclosure and protected by the following claims.

Embodiments of the subject matter and the functional operations described in this specification may be implemented in electrical or electromechanical means, including the structures disclosed in this specification and their structural equivalents, or in combinations of one or more of them. Embodiments of the subject matter described in this specification may be implemented as an electrical or electromechanical unit.

While this specification contains many specifics, these should not be construed as limitations on the scope of any invention or of what may be claimed, but rather as descriptions of features that may be specific to particular embodiments of particular inventions. Certain features that are described in this specification in the context of separate embodiments may also be implemented in combination in a single embodiment. Conversely, various features that are described in the context of a single embodiment may also be implemented in multiple embodiments separately or in any suitable subcombination. Moreover, although features may be described above as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

While various embodiments have been described, it is to be understood that the embodiments described are illustrative only and that the scope of the subject matter is to be accorded a full range of equivalents, many variations and modifications naturally occurring to those of skill in the art from a perusal hereof

What is claimed is:

1. A can opener, comprising:

a platform having a first surface opposing a second surface, the first surface having a perimeter;

a plurality of arms operatively coupled to the first surface of the platform, each of said plurality of arms having a respective blade operatively coupled to a respective portion of the respective arm;

a lever pivotally coupled to the platform such that pivoting movement of the lever toward the platform rotates each of said plurality of arms to extend each respective blade outward toward the perimeter of the first surface of the platform, and a spring configured to compress when the lever is moved toward the platform.

2. The can opener of claim 1, wherein the first surface of the platform is configured to be disposed over an outer rim of a can such that each of the respective blades is at least partially below a top edge of the outer rim.

3. The can opener of claim 2, wherein each respective blade is configured to engage a respective portion of an inner face extending downward from the top edge of the outer rim of the can when the lever is moved toward the platform and when the first surface of the platform is disposed over the outer rim of the can.

4. The can opener of claim 3, wherein each respective blade is configured to cut along the inner face extending downward from the top edge of the outer rim of the can when the lever is disposed adjacent the platform, the platform is rotated, and when the first surface of the platform is disposed over the outer rim of the can.

5. The can opener of claim 2, further comprising a hook or magnet operatively coupled to the first surface of the platform and configured to maintain engagement with a top surface of the can.

6. The can opener of claim 1, wherein each respective blade is operatively coupled to a respective one of said plurality of arms to allow 360 degree rotation of each respective blade with respect to the respective one of said plurality of arms about an axis orthogonal to the first surface of the platform.

7. The can opener of claim 1, further comprising a gear operatively coupled to the lever and the respective portion of each of said plurality of arms such that movement of the lever toward the platform rotates the gear to rotate each of said plurality of arms to extend each respective blade outward toward the perimeter of the first surface of the platform.

8. The can opener of claim 1, further comprising a bottle opener operatively coupled to the platform and configured to engage a lip of a cap disposed on a bottle.

9. The can opener of claim 1, wherein the platform comprises a first portion and an elongated handle extending from the first portion, wherein movement of the lever toward the handle rotates each of said plurality of arms to extend each respective blade outward toward the perimeter of the first surface.

10. The can opener of claim 1, wherein at least a portion of the can opener is formed from a metal or a rigid plastic.

11. The can opener of claim 1, wherein a portion of the lever comprises a plurality of grooves configured to form a handgrip.

12. A device, comprising:

a base having a first surface opposing a second surface and having an opening extending between the first and second surfaces, the opening having an inner face;

a plurality of arms, each of said plurality of arms rotatably coupled to the first surface of the base at a respective first end of each arm and comprising a respective blade disposed at a respective second end of each arm, each respective blade disposed within the opening of the base, wherein each of said plurality of arms is configured to rotate with respect to the base about a respective arm axis orthogonal to the first surface of the base, and each of the respective blades is configured to rotate about a respective blade axis orthogonal to the first surface of the base and parallel to the arm axes; and a lever operatively coupled to the base such that, when the lever is in a first position, each respective second end is a first distance from the inner face of the opening and, when the lever is operated toward a second position, each respective second end is rotated outward toward the inner face of the opening such that each respective blade is configured to engage an object disposed between the inner face of the opening and each respective blade.

13. The device of claim 12, further comprising a gear operatively coupled to the lever and the respective second end of each of said plurality of arms wherein the gear is configured to rotate when the lever is operated toward the second position.

14. The device of claim 12, wherein each respective blade is configured to engage a respective portion of an inner face extending downward from a top of a container when the lever is operated toward the second position and the top of the container is disposed between the inner face of the opening and each respective blade.

15. The device of claim 14, wherein each respective blade is further configured to cut along the inner face extending downward from the top of the container when the lever is in the second position, the base is rotated, and the top of the container is disposed between the inner face of the opening and each respective blade.

16. A method, comprising:

positioning a surface of a platform of a device over an outer rim of a container, the surface having a perimeter;

extending each of a plurality of blades outward toward the perimeter of the surface to engage respective portions of an inner face extending downward from a top edge of the outer rim of the container by rotating a gear by compressing a lever of the device toward the platform, wherein the gear is operatively coupled to each of the plurality of blades; and cutting the inner face extending downward from the top edge of the outer rim of the container by maintaining the lever compressed and rotating the platform.

17. The method of claim 16, further comprising maintaining engagement with a top surface of the container with a hook or magnet of the device.

18. A method, comprising:

positioning a surface of a platform of a device over an outer rim of a container, the surface having a perimeter;

extending each of a plurality of blades outward toward the perimeter of the surface to engage respective portions of an inner face extending downward from a top edge of the outer rim of the container by compressing a lever of the device;

cutting the inner face extending downward from the top edge of the outer rim of the container by maintaining the lever compressed and rotating the platform; and maintaining engagement with a top surface of the container with a hook or magnet of the device.

* * * * *